US007779658B2

(12) United States Patent
Matsushita

(10) Patent No.: US 7,779,658 B2
(45) Date of Patent: Aug. 24, 2010

(54) LOCKING DEVICE AND UNAUTHORIZED UNLOCKING PREVENTION METHOD

(76) Inventor: Teruaki Matsushita, 17-4, Umamiminami 3-chome, Kouryou-cho, Kitakatsuragi-gun, Nara (JP) 635-0833

( * ) Notice: Subject to any disclaimer, the term of this patent is extended or adjusted under 35 U.S.C. 154(b) by 0 days.

(21) Appl. No.: 11/877,928

(22) Filed: Oct. 24, 2007

(65) Prior Publication Data

US 2008/0049559 A1 Feb. 28, 2008

Related U.S. Application Data

(63) Continuation of application No. PCT/JP2005/020232, filed on Nov. 2, 2005.

(30) Foreign Application Priority Data

Apr. 25, 2005 (WO) ..... PCT/JP2005/007856

(51) Int. Cl.
*E05B 37/00* (2006.01)
*E05B 73/00* (2006.01)

(52) U.S. Cl. ..... 70/30; 70/315

(58) Field of Classification Search ..... 70/30, 70/51, 58, 59, 315, 14–19, 49, 446, 53, 60–62, 70/312, 27, 29, 416, 423, 427
See application file for complete search history.

(56) References Cited

U.S. PATENT DOCUMENTS 288,559 A * 11/1883 Ekl et al. ..... 70/27
345,340 A * 7/1886 Volke ..... 70/25
558,981 A * 4/1896 Poe et al. ..... 70/27

(Continued)

FOREIGN PATENT DOCUMENTS

JP 58 015564 Y2 3/1983

(Continued)

OTHER PUBLICATIONS

English language Abstract of JP 8-035363, which was filed on Feb. 6, 1996.

(Continued)

*Primary Examiner*—Peter M Cuomo
*Assistant Examiner*—Alyson M Merlino
(74) *Attorney, Agent, or Firm*—Greenblum & Bernstein, P.L.C.

(57) ABSTRACT

A locking device comprising: a lock body; a plurality of dial rings; and a fixing member which is elongated in shape and is locked by being directly fixed with the plurality of dial rings, wherein said fixing member includes a convex-concave part with repeated concaves and convexes formed in the longitudinal direction of said fixing member, each of said dial rings includes a cutout which is provided on a part of the circumferential direction in such a manner that allows said fixing member to be freely inserted/withdrawn at a rotation position which is the unlocking position and that one of said dial ring abuts the convexes of the concave-convex part at a rotation position except for the unlocking position, said locking device includes a passage for inserting/withdrawing said fixing member, a part of the passage is a hole which reaches said dial rings from outside said locking device, and the hole is curved or flexed such that said dial rings are invisible from outside said locking device via the hole, and thus preventing the part for unlocking from being seen from outside the locking device.

6 Claims, 21 Drawing Sheets

U.S. PATENT DOCUMENTS

| | | | | | |
|---|---|---|---|---|---|
| 596,596 | A | * | 1/1898 | Johnson | 70/25 |
| 601,801 | A | * | 4/1898 | Steen | 70/27 |
| 707,676 | A | * | 8/1902 | Coughlen | 70/27 |
| 796,907 | A | * | 8/1905 | Graf | 70/28 |
| 903,680 | A | * | 11/1908 | Cowie | 70/27 |
| 954,795 | A | * | 4/1910 | Greer | 70/27 |
| 1,017,313 | A | * | 2/1912 | Quaintance | 70/28 |
| 1,168,107 | A | * | 1/1916 | Oldham | 70/14 |
| 1,172,970 | A | * | 2/1916 | Fowler | 70/27 |
| 1,415,327 | A | * | 5/1922 | Fonos | 70/27 |
| 1,462,238 | A | * | 7/1923 | Mennillo | 70/15 |
| 1,507,213 | A | * | 9/1924 | Singer et al. | 70/27 |
| 1,527,727 | A | * | 2/1925 | Zweiman | 70/25 |
| 2,055,907 | A | * | 9/1936 | Menchen | 70/14 |
| 4,003,227 | A | * | 1/1977 | Casey | 70/14 |
| 5,027,623 | A | * | 7/1991 | Ling | 70/26 |
| 5,193,367 | A | * | 3/1993 | Ling | 70/28 |
| 5,636,539 | A | * | 6/1997 | Tsai | 70/315 |
| 5,850,751 | A | | 12/1998 | Kuo | |
| 5,899,099 | A | * | 5/1999 | Tsai | 70/26 |
| 6,675,614 | B2 | * | 1/2004 | Lai | 70/25 |
| 6,684,667 | B2 | * | 2/2004 | Young | 70/18 |
| 6,711,922 | B1 | * | 3/2004 | Tsai | 70/312 |
| 6,799,445 | B1 | * | 10/2004 | Tsai | 70/30 |
| 6,883,355 | B2 | * | 4/2005 | Lai | 70/25 |

FOREIGN PATENT DOCUMENTS

| | | | |
|---|---|---|---|
| JP | 58 053409 | Y2 | 12/1983 |
| JP | 61 098160 | U | 6/1986 |
| JP | 61 173671 | U | 10/1986 |
| JP | 3-224975 | | 10/1991 |
| JP | 6 061999 | U | 9/1994 |
| JP | 6 067753 | U | 9/1994 |
| JP | 8-035363 | | 2/1996 |
| JP | 2003-138824 | | 5/2003 |

OTHER PUBLICATIONS

English language Abstract of JP 3-224975, which was filed on Oct. 3, 1991.

English language Abstract of JP 2003-138824, which was filed on May 14, 2003.

U.S. Appl. No. 11/877,882 to Matsushita, filed Oct. 24, 2007.

U.S. Appl. No. 11/877,879 to Matsushita, filed Oct. 24, 2007.

* cited by examiner (a)

(b)

(a)

(b)

LOCKING DEVICE AND UNAUTHORIZED UNLOCKING PREVENTION METHOD

CROSS REFERENCE TO RELATED APPLICATION

This is a continuation application of PCT application No. PCT/JP2005/020232 filed Nov. 2, 2005, designating the United States of America.

BACKGROUND OF THE INVENTION (1) Field of the Invention

The present invention relates to a locking device and an unauthorized unlocking prevention method which prevents unauthorized unlocking.

(2) Description of the Related Art

There are a conventional dial lock which can be reassembled for changing the unlocking umber of the dial rings, and a wire lock in which a fixing member can is detachable from the lock body. These techniques are disclosed in Japanese Patent Application Laid-Open Publication No. 8-35363 and Japanese Utility Model Application Laid-Open Publication No. 6-67753.

However, the conventional locking device requires many types of components, which results in a high manufacturing cost.

In addition, when developing a locking device, although much attention has been paid to enforce the components of the locking device, not much importance has been put on replacing the components of the locking device. Thus, even with a highly flexible material, only robust, durable materials have been used for the components of the locking device. This caused a structural restraint in shape of the locking device.

In addition, it is almost impossible to lock various umbrellas using, for example, the conventional mobile locking device, and the cost for manufacturing an umbrella increases if the locking device is incorporated into the umbrella itself. In addition, a band-type lock using a fixing member which can be fixed at any position has been proposed. However, there is a problem that the fixing position can be seen from the gap of the passage for fixing member, and the durability of the band and cost performance issue, it is not widely used.

To put it differently, a locking device with low cost performance is less likely to be widely used for locking an inexpensive object such as an umbrella.

Thus, it is an object of the present invention to provide a locking device which can be easily handled and used.

More specifically, it is an object of the present invention to provide a locking device which enables preventing unauthorized unlocking with a small number of types of components.

Furthermore, it is also an object of the present invention to provide a unauthorized unlocking prevention method which prevents unauthorized unlocking of the locking device.

In addition, it is also another object of the present invention to provide a locking device which can be easily disassembled and assembled, and in which the components can be replaced at low cost.

SUMMARY OF THE INVENTION

In order to solve the problem above, the locking device according to a non-limiting embodiment of the present invention may include a lock body, a plurality of dial rings, and a fixing member which may be elongated in shape and may be locked by being directly fixed with the plurality of dial rings. The fixing member may include a convex-concave part with repeated concaves and convexes formed in a longitudinal direction of the fixing member. Each of the plurality of dial rings may include a cutout which is provided on a part of a circumferential direction in such a manner that allows the fixing member to be freely insertable and removable at a rotation position which is an unlocking position and that at least one of the plurality of dial rings abuts the convexes of the concave-convex part at a rotation position except for the unlocking position. The locking device further includes a passage for removably inserting the fixing member, and a part of the passage is a hole which reaches one of the plurality of dial rings from outside the locking device, and the part of the passage is curved or flexed such that the cutout of each of the plurality of dial rings is invisible from outside the locking device via the hole.

With this, the dial ring closest to the opening open to outside the lock of the passage formed in the lock body and the shaft member is made unable to be seen. More specifically, it is possible to prevent a part for unlocking from being seen.

This effect to prevent the unlocking part from being seen by curved or flexed passage for the fixing member is achieved in the locking device which includes dial rings and in which the passage for the fixing member in the member such as the lock body passes through from outside the lock to the dial rings. More specifically, the part for unlocking can be prevented from being seen regardless of the existence of the shaft, or whether the position where the fixing member is in the dial ring or out of the dial ring.

In addition, when the passage is so curved or flexed that the dial rings cannot be seen from outside the lock body via the passage, the fixing member can be locked at any position when the passage passes through the lock body, and wherein the concave-convex part of the fixing member includes more convexes or concaves than the number of the plurality of dial rings. Furthermore, the width of the passage may be a size which allows layered fixing members or a layered fixing member to pass through, the cutout of said plurality of dial rings allows said plurality of layered fixing members or one of said layered fixing member to be freely inserted/withdrawn at a rotation position which is the unlocking position, as well as allows the plurality of dial rings to abut a predetermined convex of the concave-convex part of the plurality of layered fixing members or one of said layered fixing member.

As described above, the unlocking part cannot be seen since the passage for fixing member is curved or flexed. Thus, by having wider width of the passage for fixing member than a passage for locking a single fixing member, not only one but multiple fixing members, or layers fixing members can be locked with the dial rings.

More specifically, when the width of the passage for fixing member is wider than the width of the passage for locking a single fixing member, there is a possibility that the part for unlocking in the dial ring is seen easily from the gap when the single fixing member is locked. However, with the passage from the opening which is open to outside the lock of the passage for fixing member to the closest dial ring, it is possible to prevent the shape of the fixing part from being seen.

According to other non-limiting features of the present invention, the locking device may further include a shaft member which is to be held by the lock body, wherein the shaft member is a rotation shaft of the plurality of dial rings. The lock body may include a body shaft hole or a body shaft opening to which the shaft member is inserted from outside and a body side groove or a body side hole to which the fixing member is inserted. The shaft member may include a shaft side groove or a shaft side hole to which the fixing member is inserted, and the body side groove or the body side hole is located where the passage is formed with the body side groove or the body side hole and the shaft side groove or the shaft side hole, wherein at least a part of the shaft side groove or the shaft side hole is formed in a direction different from a direction of removably inserting the shaft member with respect to the body shaft hole or the body shaft opening of the lock body.

With this, even if the shaft side groove or the shaft side hole passes through the shaft member, the shaft member of the dial ring is locked to the lock body when the fixing member is locked with the dial ring, which disables the shaft member being withdrawn from the lock body. Meanwhile, by unlocking the fixing member from the dial ring and removing the fixing member from the shaft side groove (for fixing member) and shaft side hole (for fixing member), locking of the shaft member to the lock body can be unlocked. In other words, this is an example of a locking device in which easy disassembling and assembling can be repeated.

In addition, when the fixing member is locked by a dial ring with the fixing member in the shaft side groove in a direction at least a part of which is different from the inserting/withdrawing direction of the shaft member to the lock body, the shaft member is locked to the lock body and thus, the shaft member and the dial ring cannot be disassembled from the lock body. This structure is useful for decreasing the number of components of the lock which can be repeatedly disassembled and assembled.

Here, the fixing member which is elongated in shape refers to fixing members in a band shape, a belt shape, a wire shape and a chain shape.

According to another non-limiting feature of the present invention, the body side groove may be located on an inner periphery of the body shaft hole or the body shaft opening so that the shaft side groove and the body side groove form a hole or an opening when the shaft member is inserted to the body shaft hole or the body shaft opening, and wherein at least a part of a direction of the hole or the opening formed with the shaft side groove and the body side groove is formed in a direction different from the direction of removably inserting the shaft member with respect to the body shaft hole or the body shaft opening of the lock body.

With this, an effect that when the fixing member is locked with a dial ring, the shaft member of the dial ring is locked to the lock body, and when the fixing member is unlocked with the dial ring and the fixing member is removed from the shaft side groove, the lock of the shaft member with respect to the lock body is unlocked can be provided.

According to yet another non-limiting feature of the present invention, the lock body may include a wall restraining a movement of the plurality of dial rings toward the direction, with respect to the lock body, of inserting the shaft member, the shaft member includes a flange, at the back edge, for preventing the plurality of dial rings from being withdrawn, the plurality of dial rings are restrained from moving to the direction of removably inserting the shaft member with respect to the lock body by the flange and the wall of the lock body.

According to still another non-limiting feature of the present invention, the lock body may include walls restraining the movement of the plurality of dial rings in the direction of removably inserting the shaft member with respect to the body shaft hole or the body shaft opening of the lock body. The lock body may further include an inserting part to which a part of the fixing member is inserted, wherein at least an end of the shaft side groove of both ends of the shaft side groove in the direction of removably inserting the fixing member is not on an edge face of the shaft member and only on the circumference of the shaft member, and wherein the inserting part is located on a position continuous to the end of the shaft side groove on the circumference, and the shaft side groove is not provided between the inserting part and the end of the shaft side groove on the circumference.

With these structures, it is possible to provide an effect that the shaft member of the dial ring is locked to the lock body when the fixing member is locked with the dial ring, the lock of the shaft member with respect to the lock body is unlocked when the lock of the fixing member with the dial ring is unlocked and the fixing member is removed from the shaft side groove. In other words, a locking device which can be disassembled only when unlocked can be implemented.

According to an even further non-limiting feature of the present invention, the passage may pass through the lock body, and wherein the concave-convex part of the fixing member may include more convexes or concaves than the number of the plurality of dial rings.

With the structures described above, the locking device according to the present invention can lock various object with a fixing member which is elongated in shape. Furthermore, the structure using the elongated fixing member which is to be fixed at any position is effective for locking various objects by adopted to a dial lock with a shaft regardless of the direction of the shaft side groove or the shaft side hole.

As described above, the locking device according to the present invention is a locking device which can be easily handled and used, including a feature which enables disassembling and assembling only when unlocked. Therefore, the components necessary for assembling the locking device such as the lock body can be individually provided. The locking device is also safe for assembling by the user.

With the present invention, it is possible to provide a locking device which can be easily handled and used, the present invention including at least a locking device and an unauthorized unlocking prevention method which prevent unauthorized unlocking.

FURTHER INFORMATION ABOUT TECHNICAL BACKGROUND TO THIS APPLICATION

The disclosure of PCT Application No. PCT/JP2005/007856 filed on Apr. 25, 2005 including specification, drawings and claims is incorporated herein by reference in its entirety.

The disclosure of PCT application No. PCT/JP2005/020232 filed on Nov. 2, 2005, including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENT

The embodiment of the present invention is described hereafter with reference to the drawings.

First of all, an overview of the dial lock 1 is described with reference to FIGS. 1 to 4.

Figure 1:
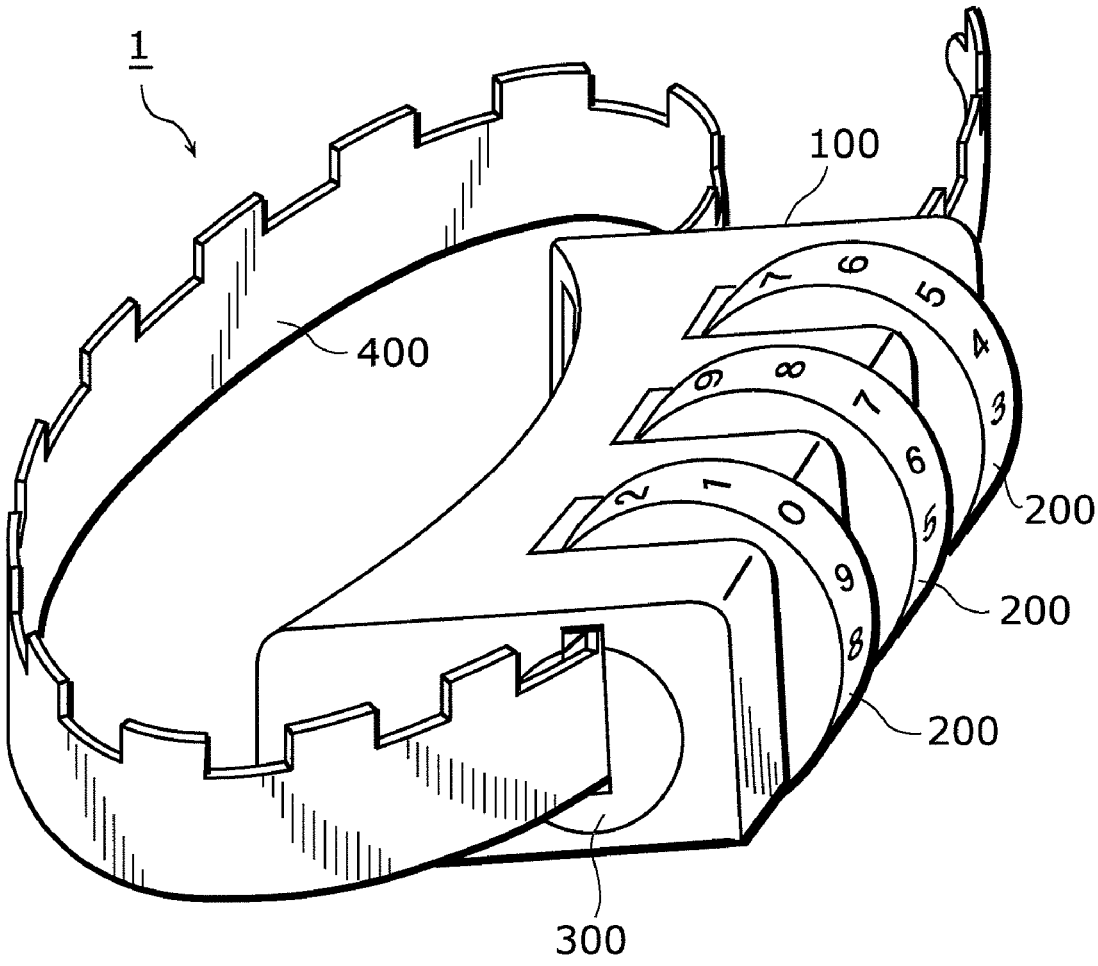
FIG. 1 shows a schematic perspective view of a dial lock according to the embodiment of the present invention.

FIG. 1 is a schematic perspective view of dial lock 1. The dial lock 1 is an example of the locking device according to the present invention, and is a band lock which locks an object by tightening the object with a band. A band lock is a locking device which locks the object by locking the band while the band tightens the object.

As shown in FIG. 1, the dial lock 1 includes a lock body 100, which is a center of the dial lock 1, a band 400, lock dial rings 200 which are the rings for locking the band 400 so that the band 400 cannot be inserted to/removed from the lock body 100, and a shaft 300 which sets the lock dial rings 200 to the lock body 100 in a rotatable manner and functions as a rotating shaft.

In the example shown in FIG. 1, there are three lock dial rings 200 and ten numbers from 0 to 9 are printed in even distance on the outer surface of each of the lock dial rings 200 in a radial direction. By rotating the three lock dial rings 200 and aligning a three-digit number for unlocking, the band 400 can be inserted to/removed from the lock body 100.

Note that the band 400 and each of the bands to be described later are examples of the fixing member according to the present invention.

The structure of band lock can be classified into a dial lock, a cylinder lock, and a card lock.

A dial lock is a locking device which is unlocked when the dial rings are at certain positions after rotation. A cylinder lock is a locking device which is unlocked when a key is inserted to a cylinder and rotated to a certain direction, a member for fixing the fixing unit of the band is set apart the locking unit of the band, and is locked when the cylinder is rotated in the other direction, the member for fixing the fixing unit of the band fixes the fixing unit of the band. A card key is a locking device which is unlocked when a card is inserted, a member for fixing the fixing unit of the band is set apart from the fixing unit of the band, and is locked when the card is removed, the member for fixing the fixing unit of the band fixes the fixing unit of the band. In addition, the card lock includes a lock referred to as a plate lock, which is unlocked from being locked by inserting a plate key in the form of a plate.

Band locks can be locked by tightening an object at a predetermined position, and thus they are particularly useful since they can be used for locking at a narrowing portion. In addition, band locks can be used for locking an object with a size of certain range since they can be locked at a predetermined position. Therefore, band locks are highly useful to prevent umbrellas from being stolen or to prevent shoplifting of goods.

However, band locks has lower rigidity (strength) than U-shaped locks, chain locks and wire locks. In addition, there is a limit in increasing the strength of bands and thus the strength of the band lock is lower than other locking devices. For this reason, band locks have rarely been attracted attention due to the strength issue. It may have been assumed that even if band locks are manufactured and sold, not many would purchase such locks which are not as useful or effective as their purchase prices.

However, the rigidity of band locks can possibly be compromised to some extent by limiting objects for use and the usage of band locks. More specifically, industrial applicability of band locks can be improved by providing band locks at low price and replacing their components easily at low cost. In other words, band locks may not be enhanced in structural strength depending on their usage. Therefore, it is crucial that the manufacturing cost is reduced in order to spread the use of band locks.

For example, stolen umbrellas and shoplifting often happens on sudden impulse. For example, umbrellas are stolen when it suddenly starts raining, and tools such as pliers and cutters are rarely used. Thus, by showing the lock being locked (for example, an umbrella or goods being locked by a band key connected to an immobile object with a wire), the impulse for stealing or shoplifting can be controlled to some degree.

For this reason, if the band lock is strong enough not to be broken easily with hands, it is fully useful as a lock.

Thus, the components making up of the dial lock 1 are at least as strong so as not to be torn by hands, and are made of plastic. Therefore, the components making up of the dial lock 1 to be shown below are made of plastic unless otherwise indicated.

Figure 5:
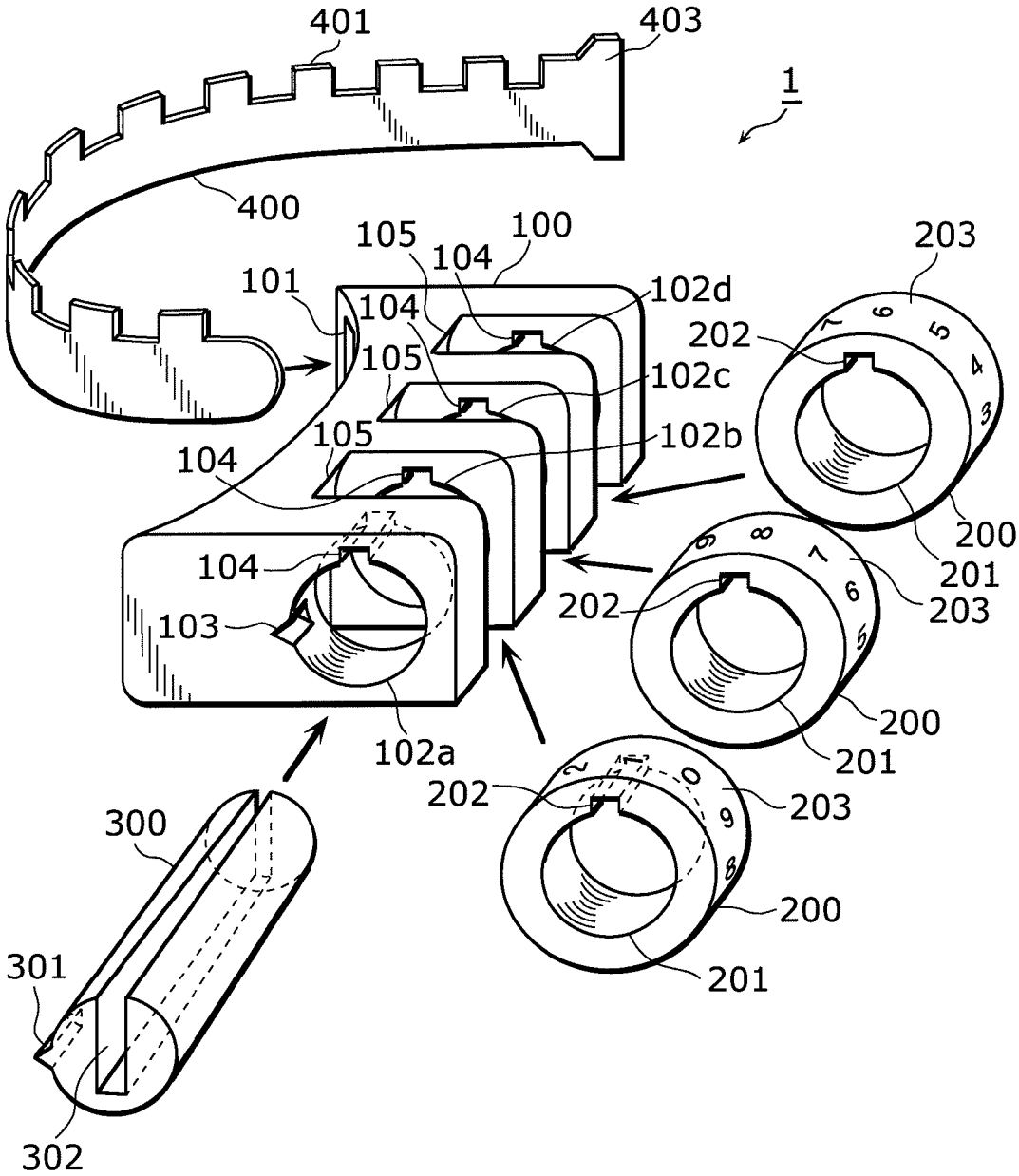
FIG. 5 shows a schematic perspective view illustrating the components making up of the dial lock of FIG. 1.

As described above, the dial lock 1 of the present invention is a band lock and the unit which locks the band is a dial lock. FIG. 5, which will be described later shows an schematic view of each of the components of the dial lock 1 shown in FIG. 1. Since the number of components making up of the dial lock 1 is small and each of the components is independent, they are exchangeable. Additionally, the lock can be repeatedly assembled/disassembled when it is unlocked.

Note that fixing member other than bands can be used for the locking device according to this embodiment.

Figure 2:
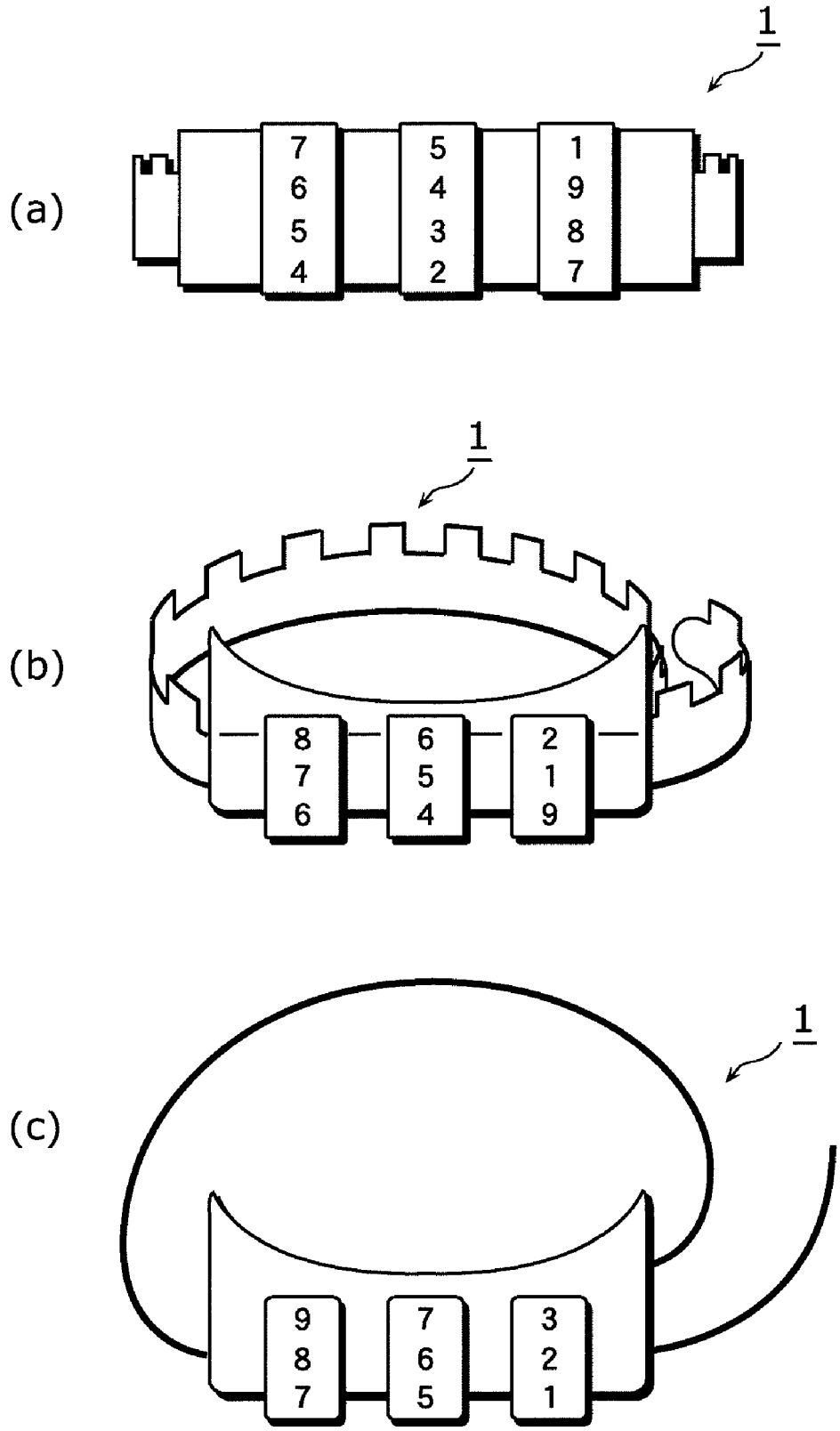
FIG. 2 shows schematic views of the dial lock of FIG. 1 from front, diagonal front, and top.

FIG. 2 (*a*) shows a schematic front view of the dial lock 1 and FIG. 2 (*b*) shows a diagonally front schematic view of the dial lock 1, and FIG. 2 (*c*) shows a top schematic view of the dial lock 1.

Figure 3:
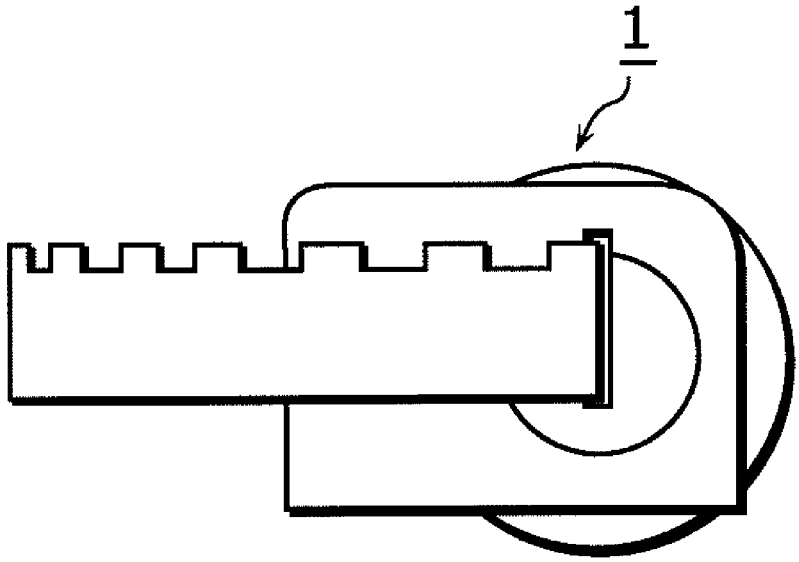
FIG. 3 shows a schematic side view of the dial lock of FIG. 1.
Figure 3:
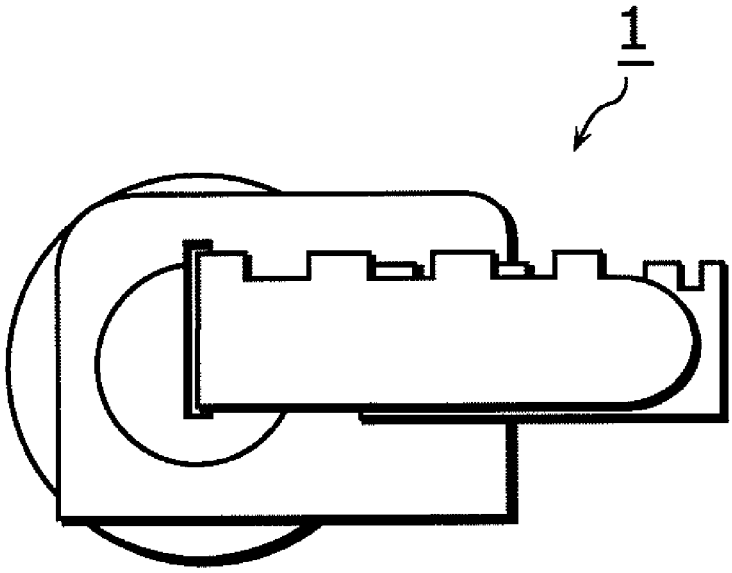

FIG. 3 (*a*) shows a left side schematic view of the dial lock 1, and FIG. 3 (*b*) is a right side schematic view of the dial lock 1.

Figure 4:
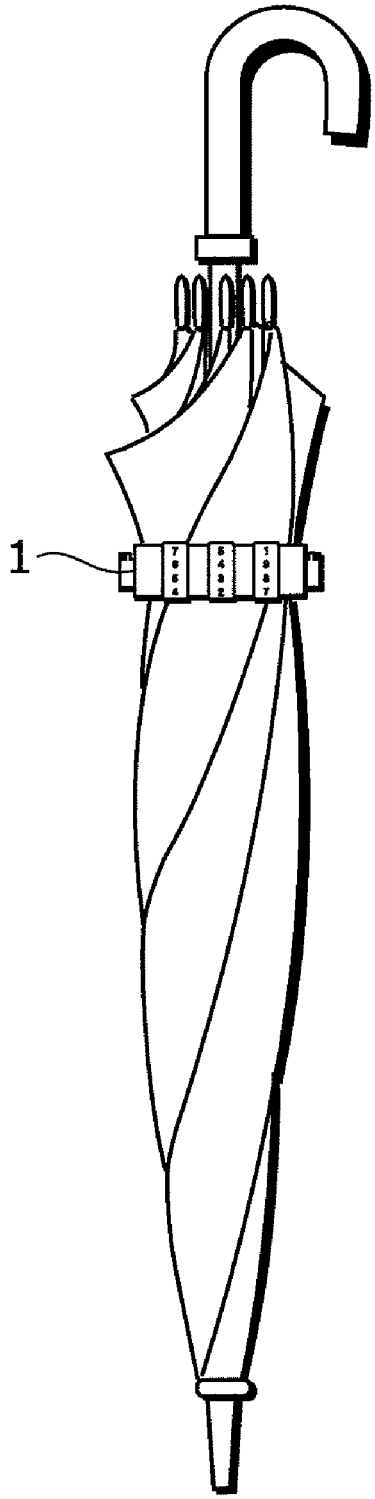
FIG. 4 shows an example a locked umbrella which is locked using the dial lock of FIG. 1.

FIG. 4 shows an example of the dial lock 1 set to an umbrella, or the umbrella being locked using the dial lock 1. Since there are joints for connecting ribs and stretchers in an umbrella and a tip cup for placing tips, the cross-sectional outside diameter of a closed umbrella, which is vertical to the axis direction of the tube is not constant and there are parts where the outside diameter is narrower than its upper part and its lower part.

Thus, the dial lock 1 cannot be easily moved above and below if the umbrella is locked by pulling the band 400 to the direction for tightening the umbrella, at a part of the closed umbrella where the outside diameter is narrower than the upper part and the lower part and in a circle formed with a band 400 shown in FIG. 1 and the lock body 100. To put it differently, the umbrella cannot be opened without unlocking the dial lock 1.

In addition, the convexes of the band 400 are for locking the band 400 with the lock dial rings 200 with respect to the shape of the lock dial rings 200 which will be described later. Furthermore, the convexes are effective for making it difficult that the dial lock 1 is being pulled out when the dial lock 1 is attached to the umbrella, by catching the umbrella fabric and the like.

Especially, when the umbrella is locked on the edges of umbrella fabric toward the ferrule from the tips of the umbrella with the dial lock 1 upside down, or, the convexes of the band 400 facing the ferrule direction of the umbrella, the convexes are caught at the edges, and consequently the dial lock 1 is hardly pulled out in the ferrule direction. This method is one of the effective locking methods for preventing umbrellas being stolen. Examples of other locking methods will be described in detail in the description for FIG. 8.

Note that an umbrella and may be tied up with other objects, for example, together with a pole or cross bars of umbrella stand by the band 400. This will further prevents stealing.

Next, the structure of dial lock will be described with reference to FIGS. 5 and 6.

FIG. 5 shows a schematic perspective view illustrating the overview of the lock body 100, the shaft 300, the lock dial rings 200, and the band 400 making up of the dial lock 1.

As shown in FIG. 5, the lock body 100 includes: a band setting hole 101 for attaching the band 400; a lock side shaft hole 102*a*, a lock side shaft hole 102*b*, a lock side shaft hole 102*c* and a lock side shaft hole 102*d* for attaching the shaft 300 to the lock body 100; and a dial setting unit 105 which is a space for attaching the lock dial rings 200 to the lock body 100.

Note that three dial setting units 105 are provided at equal distance in the longitudinal direction of the lock body 100. Thus, the three lock dial rings 200 which are attached to the dial setting unit 105 are to be equally placed.

In addition, a lock body side band groove 104 are respectively provided on the lock body side shaft holes 102*a* to 102*d*. In the lock body side shaft hole 102*a*, there provided a guide cutout 103 for determining the position of the shaft 300 in circumferential direction when the shaft 300 is inserted. Note that the four lock body side band grooves 104 are arranged linearly when looked through from the lock body side shaft hole 102*a* to the lock body side shaft hole 102*d*.

As shown in FIG. 5, the lock dial ring 200 has a tube structure as a whole, and includes a ring side shaft hole 201 for passing the shaft 300 through, and a number display unit 203 for displaying numbers. In addition, a ring side band groove 202 which is a cutout for passing the band through is provided in the ring side shaft hole 201.

Note that when the shaft 300 passes through the ring side shaft hole 201, the lock dial ring 200 can be rotated in the circumferential direction of the shaft 300 with the shaft 300 as the rotating shaft.

As shown in FIG. 5, the shaft 3000 is a cylinder with a groove on the shaft direction and a guide 301 for determining the position in the circumferential direction when the shaft 300 is set to the lock body 100, and a shaft side band groove 302 for passing through the band are provided. Note that the front side of the shaft 300 shown in FIG. 5, or the edge of the shaft 300 where the guide 301 is provided is hereinafter referred to as a shaft back, and the edge on the other side is referred to as a shaft top. In addition, the shaft side band groove is an example of the shaft side groove in the locking device of the present embodiment. The shaft side groove is a groove in a shaft member where a fixing member such as a band is inserted, and as will be described with reference to FIG. 12, there may be multiple shaft side groove.

The band 400 includes: multiple convexes 401 which are provided at regular interval for locking the band 400 to the lock body 100 with the lock dial rings 200; and a stopper 403 for preventing the band 400 to slide through to the exit direction of the band setting hole 101 when the band 400 is inserted to the band setting hole of the lock body 100.

Note that there exists a concave between two adjacent convexes 401 in the band 400, thus the band 400 includes multiple concaves provided at regular interval.

The edge opposite to the stopper 403 in the band 400 is hereinafter referred to as a band top, and the part other than the stopper 403 will be referred to as a band body. The band 400 can be inserted to the band setting hole 101 of the lock body 100 from the band top, and the band top can be pulled out from the right side of the lock body 100. Furthermore, since the stopper 403 of the band 400 is larger than the end of the band setting hole 101 on the right side of the lock body 100, the band cannot pass through the lock body 100. To put it differently, the band 400 is fixed in the band setting hole 101 with the stopper 403, and is fixed with respect to the band top direction.

In addition, the fixing member passes through the shaft. The dial rings rotates with the shaft as a rotation axis. Therefore, the lock can be disassembled only when the user unlocks the lock, and with its simple structure, the user can assemble the lock.

Although the band 400 is illustrated as a U-shaped band for illustration purpose, the band 400 is not fixed in a U-shape. The band 400 is made of bendable material such as plastic and rubber, and is flexible.

The shaft 300 is first inserted to the lock body side shaft hole 102*a* from the shaft top, and is inserted until the shaft top passes through three lock dial rings 200 provided each of the three dial setting unit 105, the lock body side shaft hole 102*b* and the lock body side shaft hole 102*c*, and until being fixed to the lock body side shaft hole 102*d*. With the shaft top fixed to the lock body side shaft hole 102*d*, the shaft 300 is fixed to the lock body 100. The spatial relationship between the shaft top of the shaft 300 and the lock body side shaft hole 102 will be described with reference to FIG. 6. In addition, each of the three lock dial rings 200 can be rotated in the circumferential direction of the shaft 300 as described above.

Furthermore, when the shaft 300 is inserted to the lock body 100, the guide 301 of the shaft 300 and the guide cutout 103 of the lock body side shaft hole 102 are engaged, and thus the shaft 300 is fixed in circumferential direction with respect to the lock body 100. The shaft 300 is fixed in a position where the shaft side band groove 302 is immediately below the four lock body side band groove 104 which are arranged linearly.

Here, when each of the three ring side band grooves 202 of the lock dial rings 200 is rotated so that the ring side band grooves 202 are linearly arranged with the four lock body side band groove 104 of the lock body 100, or to put it differently, the ring side band groove 202 is immediately above the shaft side band groove 302 of the shaft 300, a band passing hole for passing through the band body of the band 400 is formed with the shaft side band groove 302, the four lock body side band groove 104, and the three ring side band groove 202.

Figure 6:
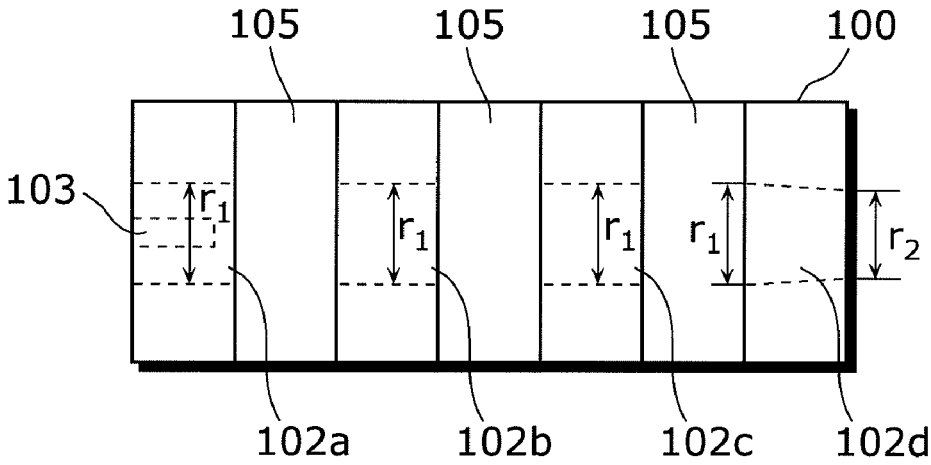
FIG. 6 shows a front perspective drawing illustrating the lock body of FIG. 5.

FIG. 6 shows a front perspective drawing illustrating the lock body 100. As described above, the shaft 300 is fixed to the lock body 100 when the shaft top fixed to the lock body side shaft hole 102*d*. The spatial relationship between the shaft top of the shaft 300 and the lock body side shaft hole 102 is described with reference to FIG. 6.

As shown in FIG. 6, r1 is the inner diameter of the lock body side shaft hole 102*a*, the lock body side shaft hole 102*b* and the lock body side shaft hole 102*c*. In addition, the left inner diameter of the lock body side shaft hole is r1 while the right inner diameter is r2. Here, r1>r2.

Here, the shaft 300 excluding the guide 301 and the shaft side band groove 302 is a cylinder, and its outer diameter is r1. More specifically, when the shaft 300 is inserted to the lock body 100 from the left side in FIG. 6, the shaft top of the shaft 300 can passes through the lock body side shaft hole 102*a*, the lock body side shaft hole 102*b*, and the lock body side shaft hole 102*c*, and can enter the lock body side shaft hole 102*d*. However, since the right side inner diameter of the lock body side shaft hole 102*d* is smaller than the outer diameter of shaft 300, the shaft top is subject to the pressure toward inner radial direction from the wall of lock body side shaft hole 102*d*. Thus, the pressure causes friction between the shaft top circle and the wall of lock body side shaft hole 102*d*, and the shaft top is fixed to the lock body side shaft hole 102*d*. With this, the shaft 300 is fixed to the lock body 100.

Note that the shaft 300 can be pulled out from the lock body 100 using, for example, a stick and a hammer from the right side of lock body 100 shown in FIG. 6 after the shaft 300 is incorporated into the lock body 100 since the shaft 300 is fixed to the lock body 100 with friction. However, when an object such as an umbrella is locked, the band body of the band 400 passes through the shaft side band groove 302 of the shaft 300 and the band is tightly locked. Thus, the shaft 300 cannot be removed.

As described above, in the dial lock 1 according to the present embodiment, the length of the part of band 400 for locking the object such as an umbrella is adjustable, and thus a closed umbrella can be locked with the dial lock 1 as shown in FIG. 4 regardless of the size and shape of the umbrella.

To put is differently, a stranger cannot open nor use the umbrella. Therefore, it is effective to prevent an umbrella from being stolen in order to use the umbrella.

In addition, when an umbrella, a pole or cross bars of umbrella stand can possibly be tied up with the band 400 with regard to the spatial relationship, the umbrella, the umbrella stand and others can be tied together by the band 400. This will further prevents stealing.

In addition, since the structure of the dial lock 1 is simple, the user who is provided with the lock body 100, the lock dial rings 200, the shaft 300, and the band 400 can assemble the dial lock 1 with ease.

In addition, since the shaft 300 can be removed from the lock body 100 after the dial lock 1 is assembled, the numbers for unlocking can always be changed.

Here, with the dial lock 1 is attached to an umbrella, the shaft 300 cannot be removed from the lock body 100, and thus only the user who knows the number for unlocking can remove the shaft from the lock body 100.

More specifically, the dial lock 1 of the embodiment of the present invention can be disassembled when it is unlocked, and can be repeatedly assembled/reassembled. In addition, it has a simple structure involving a small number of components required for assembling the lock. In the conventional dial lock, there are problems such as the number of components necessary for assembling, difficulty for assembling, and manufacturing cost. However, in the dial lock 1 these problems are solved.

In addition, making the structures of the band, the dial rings, the shaft, and the lock body capable of disassembling and assembling enables selection of material of which the lock is composed. For example, the strength, length, and shape of the band can be changed, and the strength and shape of the dial rings, the shaft, and the lock body can be changed.

More specifically, the user may purchase the components depending on the expected usage, and components made of various materials such as plastic, wood, ceramic, glass, and metal can be used. With this, it is possible to provide a band dial lock with variations at extremely low cost.

Note that a flexible coil wire can be attached to the dial lock 1. An end of the coil wire can be attached to a fixed object such as a door handle and stair rail. To put it differently, the umbrella lock with the dial lock 1 and the fixed object can be connected.

Figure 7:
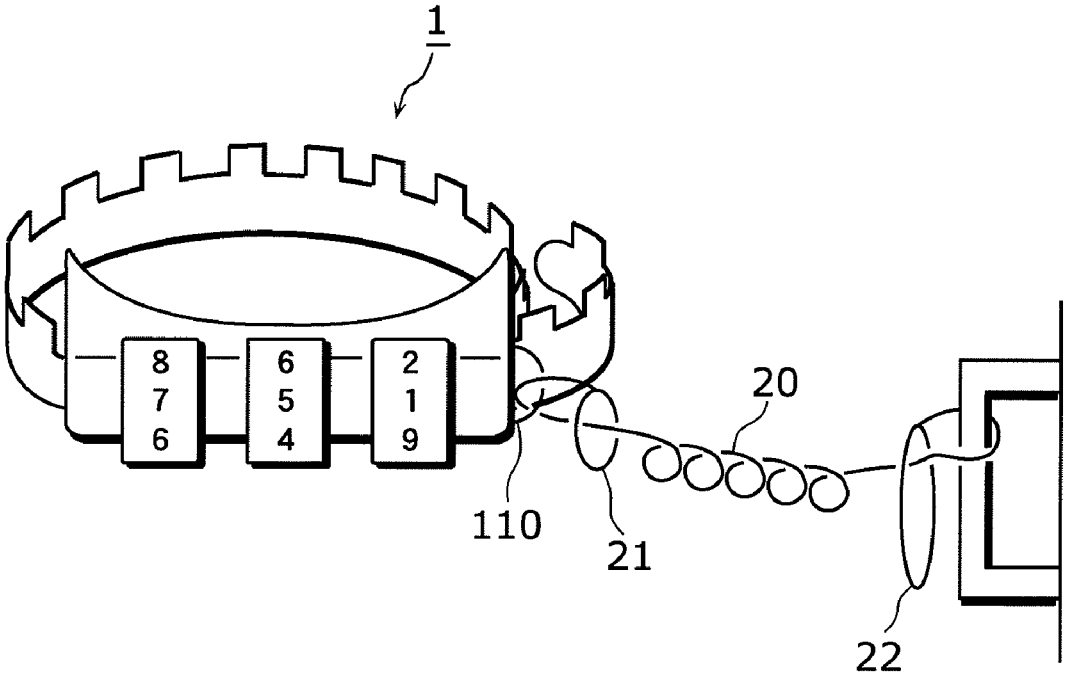
FIG. 7 shows an example in which a coil wire is attached to the dial lock of FIG. 1 and the lock is connected to the door handle with the coil wire.

FIG. 7 shows an example in which the coil wire is attached to the dial lock of FIG. 1 and the lock is connected to the door handle, which is a fixed object with the coil wire.

In the example shown in FIG. 7, the lock 100 includes a wire setting part 110 which is a U-shaped component in order to attach the coil wire 20 to the dial lock 1. In addition, the coil wire 20 includes a ring for attaching the wire to the dial lock 1 on one end, and a ring 22 for attaching the wire to a fixed object such as a door handle on the other end. The ring 21 for attaching the wire to the dial lock 1 is large enough to pass through the coil wire 20 itself, and the ring 22 for attaching the wire to a fixed object such a door handle is large enough to pass though the dial lock 1.

By passing through the ring 22 in the ring 21 after the wire passes through the wire setting part 110, the coil wire 20 is attached to the dial lock 1. Furthermore, by passing the ring 22 through the door handle shown in FIG. 7 and passing though the dial lock 1 into the ring 22, the dial lock 1 and the door handle is connected, as shown in FIG. 7.

As described above, attaching the coil wire 20 to the dial lock 1 enables the dial lock 1 to connect with other fixed objects. Consequently, the umbrella itself can be connected with a fixed object, and a stranger is not only unable to use the umbrella with the dial lock 1 but also unable to take the umbrella from the place where it is connected.

Therefore, attaching the coil wire 20 to the dial lock 1 is effective for improving stolen umbrella prevention effect.

Note that by locking a narrowing part of a locking object such as an umbrella, there is an effect which makes it unable to use the locking object, for example, not letting the umbrella open as described above. However, with a lock, there is a possibility that the whole locking object would be taken away. In addition, for example, when a long object such as an umbrella is locked and if the object is lock with the band passing through a immobile object such as a hand rail, the band may be wrenched off by twisting the long object such as an umbrella.

Thus, a method in which the lock body is connected to an object other than a band for securing the locking object, for example, the coil wire 20 shown in FIG. 7, is effective. If the immobile object has a closed circle part, the lock is made possible to connect with the immobile object by using a wire connected to the lock.

Here, the size of the ring 22 of the coil wire 20 shown in FIG. 7 is preferably the size which the dial lock 1 is passed when unlocked, and an object being locked would not pass the larger the locking object, the larger the ring 22 has to be, so that the dial lock including the locking object passes the ring 22. However, in order to achieve the stealing prevention effect of the coil wire 20 for various kinds of objects, the above-mentioned size is the most suitable. The size of ring which the lock body can pass through the ring when unlocked and with the band straightened from the lock body, but cannot pass through the ring when locked and the band being a circle since the minimum diameter of the lock becomes large, is the most suitable size of the ring 22 regardless of the size locking object.

Figure 8:
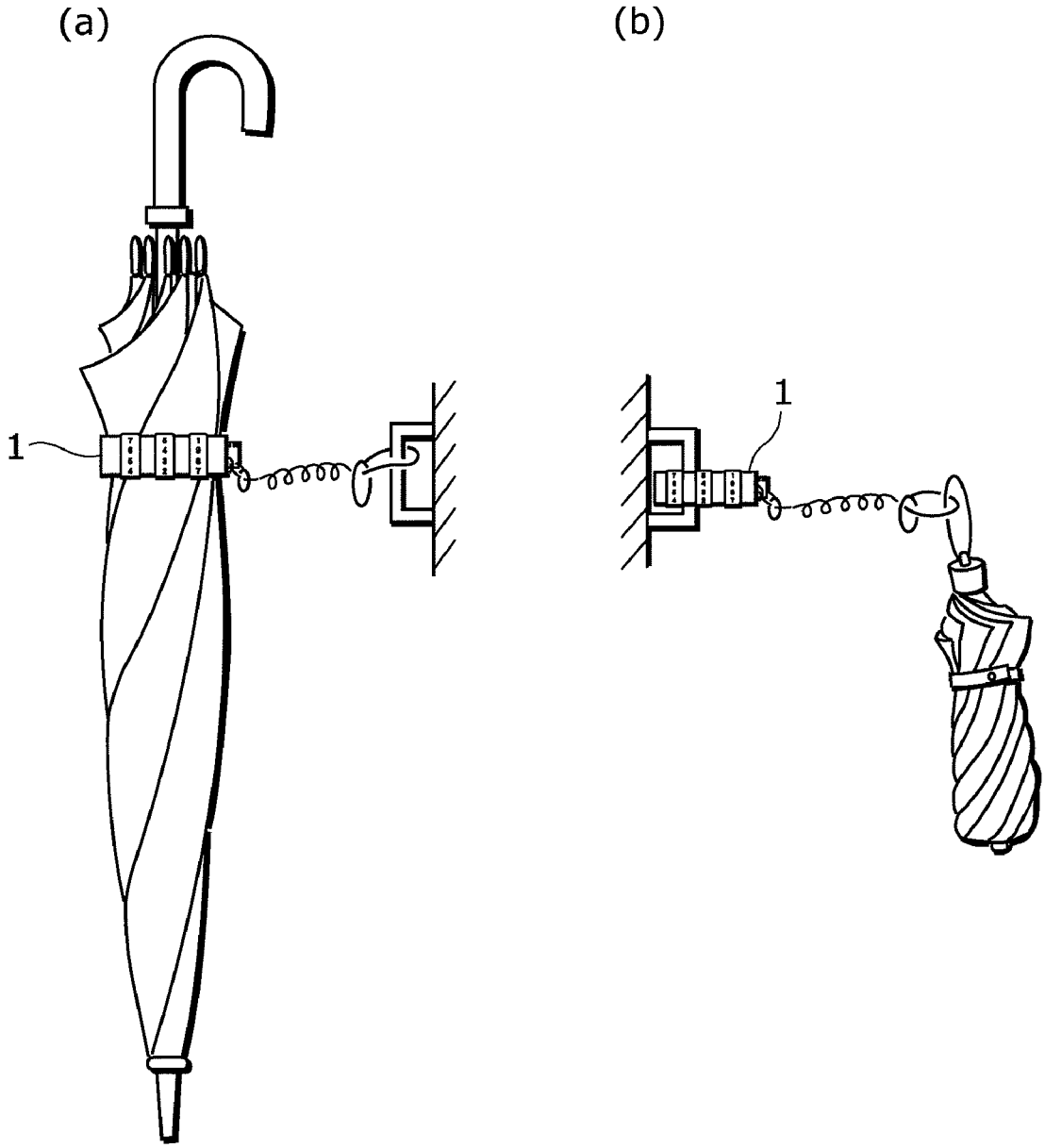
FIG. 8 shows an example in which an umbrella and a door handle is connected with a dial lock having a coil wire attached.

FIG. 8 shows an example in which an umbrella and a door handle is connected with the dial lock attached to the coil wire.

The dial lock 1 is attached to the closed stick umbrella shown in FIG. 8 (*a*), in the same manner as shown in the example of setting the dial lock 1 to the umbrella in FIG. 4. However, as shown in FIG. 8 (*b*), it is possible to link the folding umbrella with the door handle by connecting the ring 22 side of the coil wire 20 with the strap of the folding umbrella, and setting the dial lock 1 to the door handle.

In addition, there is another locking method using the coil wire 20, which sets the ring 22 side of the coil wire 20 to the umbrella tube. For example, with the umbrella open, the ring 22 side of the coil wire 20 is attached to a part of the umbrella tube between the runner and the ferrule and leave the dial lock 1 with which the coil wire 20 is connected outside the umbrella. Then close the umbrella and set the dial lock 1 to the door handle.

When the ring 22 side of the coil wire 20 is set to the part of umbrella tube between the runner and the ferrule and, and the dial lock 1 is connected to a fixed object such as a door handle, the coil wire 20 can neither be removed to the tube runner direction nor the ferrule direction, and thus the locked umbrella cannot be taken away. In addition, the same effect can be achieved by setting the ring 22 side of the coil wire 20 to the door handle and setting the dial lock 1 to the part of umbrella tube between the runner and the ferrule.

As described above, the locking method using the part of umbrella tube between the runner and the ferrule is effective when locking an umbrella with no part where the outer diameter is narrower then its upper part and lower part, or an umbrella of which hard to find such a part.

In addition, a bulge for locking may be created in a closed umbrella by using an attachment. For example, a doughnut shaped disc having an outer diameter approximately same as the umbrella tip cup, with a hole large enough to pass through a tube, and with a slit or a cutout ranging from the outer side in the radial direction to the hole. This attachment disc is set to the part of umbrella tube between the runner and the ferrule so that the tube is located in the hole of the disc. With this, a bump can be created between the runner and the ferrule when the umbrella is closed. In other words, a part where the cross-sectional outside diameter vertical to the tube is narrower than above and below can be created between the runner and the bump of the closed umbrella. By setting the dial lock 1 in the narrowing part between the bump created by this attachment and the runner, the dial lock 1 cannot be pulled out from the umbrella. In addition, multiple bumps may be created in the umbrella using multiple attachments. Note that the attachment is an example of a large diameter part member.

The locking method using the attachment is effective for locking an umbrella in which there is no bump in the joint for connecting the rib and the stretcher nor convex, the umbrella not having a concave which allows locking in the part between the tip and the ferrule when the umbrella is closed, in other words, the umbrella does not have.

Note that in FIG. 7, the coil wire 20 is attached to the wire setting part 110 which is set to the lock body 100. However, the coil wire may be attached to the dial lock 1 by another method, for example, a hole for setting the coil wire maybe provided to the lock body 100 and the coil wire 20 may be attached therein.

In addition, a wire anchoring unit for anchoring the coil wire 20 may be provided for the case when the coil wire 20 is not used.

Figure 9:
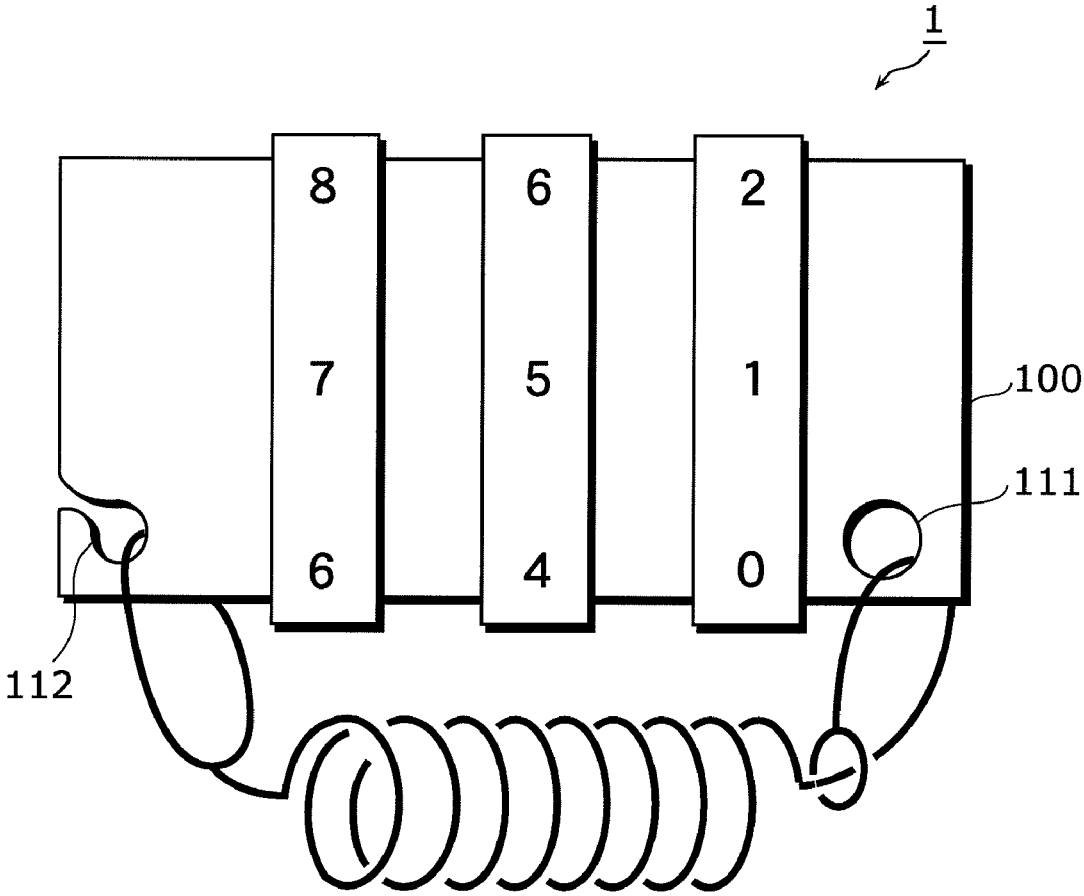
FIG. 9 shows the lock of FIG. 5 with a hole for attaching a wire and an opening for holding a wire.

FIG. 9 shows a front perspective view of the dial lock 1 when a wire setting hole 111 and the wire anchoring unit 112 is provided with the lock body 100.

As shown in FIG. 9, providing the wire setting hole 111 with the lock body 100 allows the attachment of the coil wire 20. In addition, providing the wire anchoring unit 112 enables anchoring the ring 22 of the coil wire 20 when the coil wire 20 is not used. Note that the wire anchoring unit 112 is a dent formed in the lock body 100, however, it may not be a dent as long as the ring 22 is anchored. For example, it may be a projection.

In addition, the material composing the coil wire 20 may be plastic and rubber, in addition to the elastic metal. The wire may also be straight, and not the coil shape as described above. In summary, the wire may be capable of connecting the dial lock 1 and a fixed object, as is the coil wire 20.

In addition, the lock body 100 may also take the shape other than the lock shown in FIG. 5. For example, the lock 100 may take the shape with a flat surface for the side contacting an object such as umbrellas in the lock body 100 or a curved shape.

Furthermore, as is described below, the location of a ring side band groove which is a cutout of the lock dial ring can be adjusted so that the ring side band groove is not seen from outside. This prevents the dial lock from being unlocked without authorization.

Figure 10:
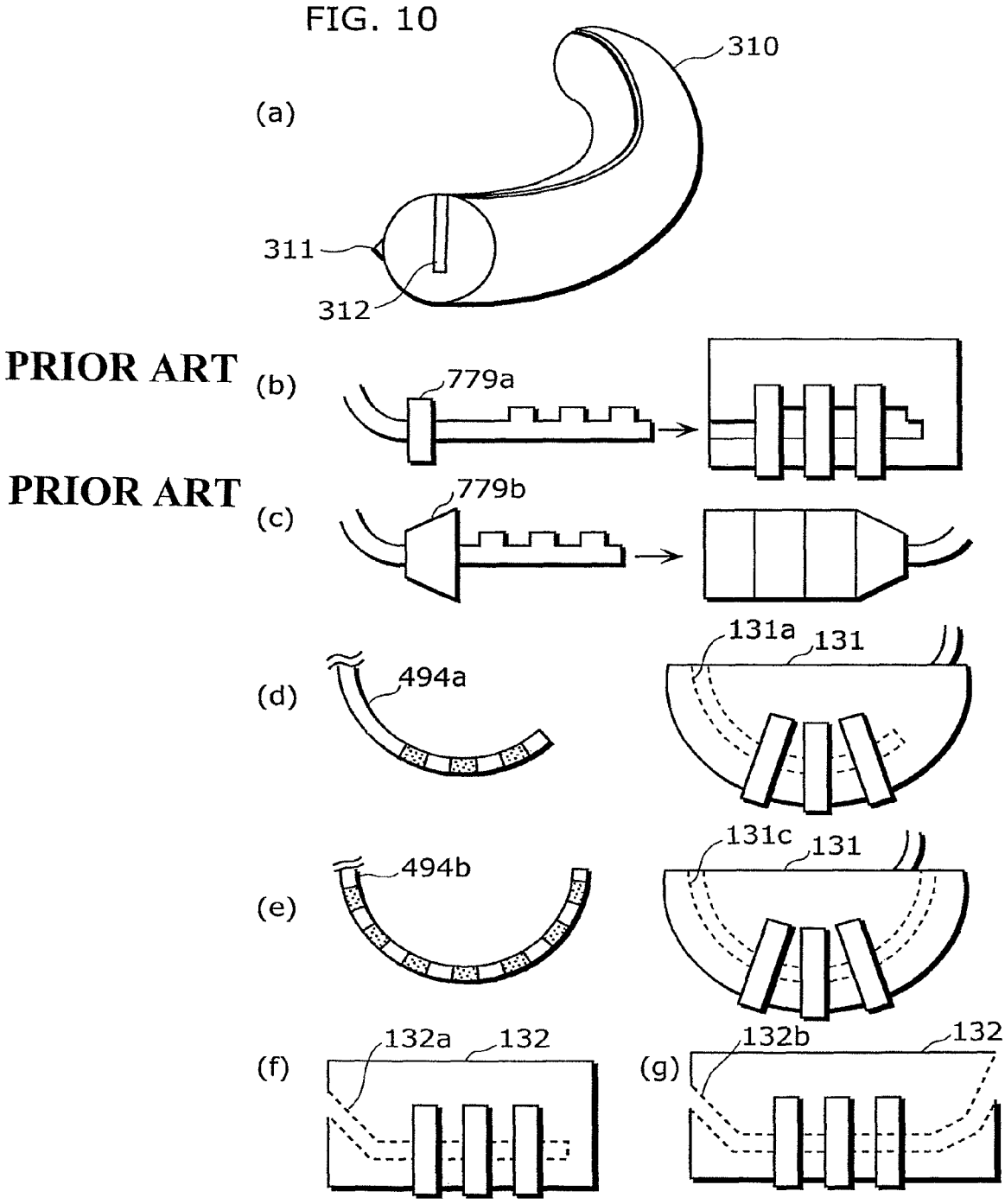
FIG. 10 shows a structure which prevents the lock dial rings from being seen.

FIG. 10 (*a*) shows an example of the curved shaft. As shown in FIG. 10 (*a*), the shaft 310 is curved so as to be inserted to the lock body of locking device of the curved shaft. In addition, as well as the shaft 300, the shaft 310 includes a guide 311 and a shaft side band groove 312, and works as the rotation shaft of the lock dial rings 200.

As described above, the shaft may be curved along with the shape of lock body as shown in FIG. 10 (*a*), and the shaft side groove may be curved as well. This prevents the lock dial rings from being seen via the shaft side groove. The fact that the lock dial rings are invisible via the shaft side groove indicates that the position of the ring side band groove which is a cutout part of the lock dial rings and a part relates to unlocking the lock is cannot be seen from outside the lock body.

Note that even in the case of a locking device without a shaft, the part for unlocking can be prevented from being seen if a band passage formed by the hole through which the band of the lock body passes is curved likewise, the unlocking unit can be prevented from being seen in the same manner. In addition, the band passage may also be flexed, not curved, in order to achieve the same effect.

In summary, in a locking device, if the passage of fixing member, the passage formed by a groove or a hole of the shaft and the lock body is curved or bent enough so that the dial rings cannot be seen through the passage, the effect which prevents the unlocking unit of the lock is being seen.

Therefore, even in a locking device in which the fixing member does not have a part or a member such as flange or an expanded part for preventing the lock from being seen, by having the passage from an opening on a outer side of lock and the dial ring which is closest to the opening so curved or bent that the passage between the opening and the dial ring cannot be seen, unauthorized unlocking by seeing the lock can be prevented.

FIG. 10 (*b*) and FIG. 10 (*c*) respectively show examples of a conventional locking device structure which prevents unauthorized peeping from outside.

The locking devices shown in FIG. 10 (*b*) and FIG. 10 (*c*) have a structure that the fixing members are locked at a certain position. In addition, both the flange 779*a* in FIG. 10 (*b*) and the expanded part 779*b* in FIG. 10 (*c*) can made unable to be seen their interior from the loading slot of the fixing member. In addition, in the locking device shown in FIG. 10 (*c*), for example, the expanded part 779*b* protects a retainer and a pin which prevent dial rings from removed of the locking device so that the locking device cannot be disassembled.

Here, in the locking device in which the fixing member is locked at a predetermined position as is the dial lock of the present embodiment, it is virtually impossible to have a structure for preventing the lock from peeping such as the flange 779*a* and the expanded part 779*b* which are fixed to the fixing member.

However, as described above, it is possible to prevent the lock from being seen externally by having the shaft side groove curved or bent. In addition, the peeping prevention effect with this structure can surely be used for the locking device in which the fixing member is locked at a certain position.

FIG. 10 (*d*) and FIG. 10 (*e*) respectively show schematic structures of the dial locks with curved shaft side grooves. FIG. 10 (*f*) and FIG. 10 (*g*) respectively show schematic structures of the dial locks with bent shaft side grooves.

As shown in FIG. 10 (*d*), even in a locking device in which the band 494*a* is locked at a predetermined position without passing through the lock body 131, the part of the lock dial rings for unlocking cannot be seen from outside the lock by having the fixing member passage 131*a* curved.

As shown in FIG. 10 (*e*), even in a locking device in which the band 494*b* is locked at a predetermined position passing through the lock body 131, the part of the lock dial rings for unlocking cannot be seen from outside the lock by having the fixing member passage 131*c* curved.

In addition, as described above, the same effect can be obtained with a bent fixing member passage, not just the curved fixing member passage. For example, as shown in FIG. 10 (*f*), in a locking device in which the fixing member passage 132*a* does not pass through the lock 132 and the fixing member is locked at a position where it is fixed, the part of the lock dial rings for unlocking cannot be seen from outside the lock by having the fixing member passage bent.

In addition, as shown in FIG. 10 (*g*), in a locking device in which the fixing member passage 132*b* passes through the lock 132 and the fixing member is locked at a predetermined position, the part of the lock dial rings for unlocking cannot be seen from outside the lock by having the fixing member passage 132*b* bent.

As described above, by having the fixing member passage curved or bent the dial rings are made impossible to be seen via the passage. To put it differently, it is possible to prevent the part of dial rings for unlocking the lock from being seen. Note that the fixing member passage is a passage formed by a shaft side groove, a shaft side hole, a body side groove, or a body side hole to which a fixing member is inserted.

More specifically, it is possible to prevent the fixing part from peeping from outside without a shaft by having a fixing member passage curved or bent as shown from FIG. 10 (*d*) to FIG. 10 (*g*).

In addition, by providing a user ten lock dial rings and by obtaining the lock dial rings having the numbers the user needs, the user can make the dial lock 1 with an unlocking number of the user's choice.

In addition, although in the description above, the band 400 and others are made of flexible material such as plastic and the like, the material making up of the band may be metal, not only plastic.

Figure 11:
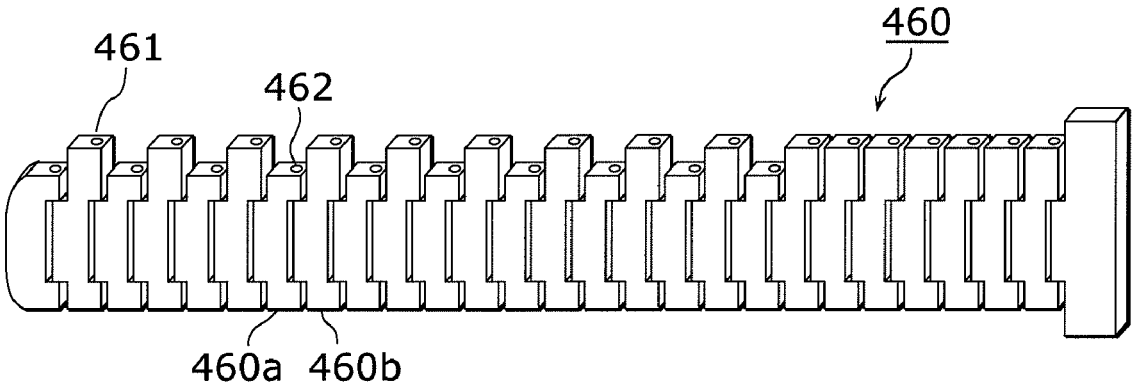
FIG. 11 shows an example of a metal band.

FIG. 11 shows the band 460 which is an example of metal band which can be used for the dial lock 1. As shown in FIG. 11, the band 460 is formed with linked metal plates like a watch band, and includes the convexes 461 like the band 400. In addition, in the band 460, adjacent members 460*a* and 460*b* are connected with pins 462 in a bendable manner.

In addition to the caterpillar band with high rigidity such as metal plate as in the metal band shown in FIG. 11, the strength of band may be improved by making the band of a highly elastic metal or by including wire even when the band is essentially made of plastic. The lock body, the dial rings and the shaft and others may be made of a material with high rigidity such as metal, and this allows provision of a sturdier locking device.

Although the shaft 300 is fixed to the lock body 100 with a friction caused by the narrowing inner diameter of the right side of the lock body side shaft hole 102 as shown in FIG. 6, the shaft 300 may be fixed with other method.

For example, by narrowing the inner diameter of the lock body side shaft hole 102*d* and tapering the shaft top of shaft 300, the shaft 300 can be fixed with friction.

More specifically, at least a part of the shaft 300, the lock body side shaft holes 102*a* to 102*d* are shaped to cause friction for fixing the shaft 300 with the lock body 100. The relationship between the shaft 300 and the lock body 100 applies to the relationship between other shaft and lock body.

In addition, the locking device according to this embodiment may have a structure which prevents the shaft taken away from the lock body by engineering the band (passing) path even when the band is loosely fastened.

Figure 12:
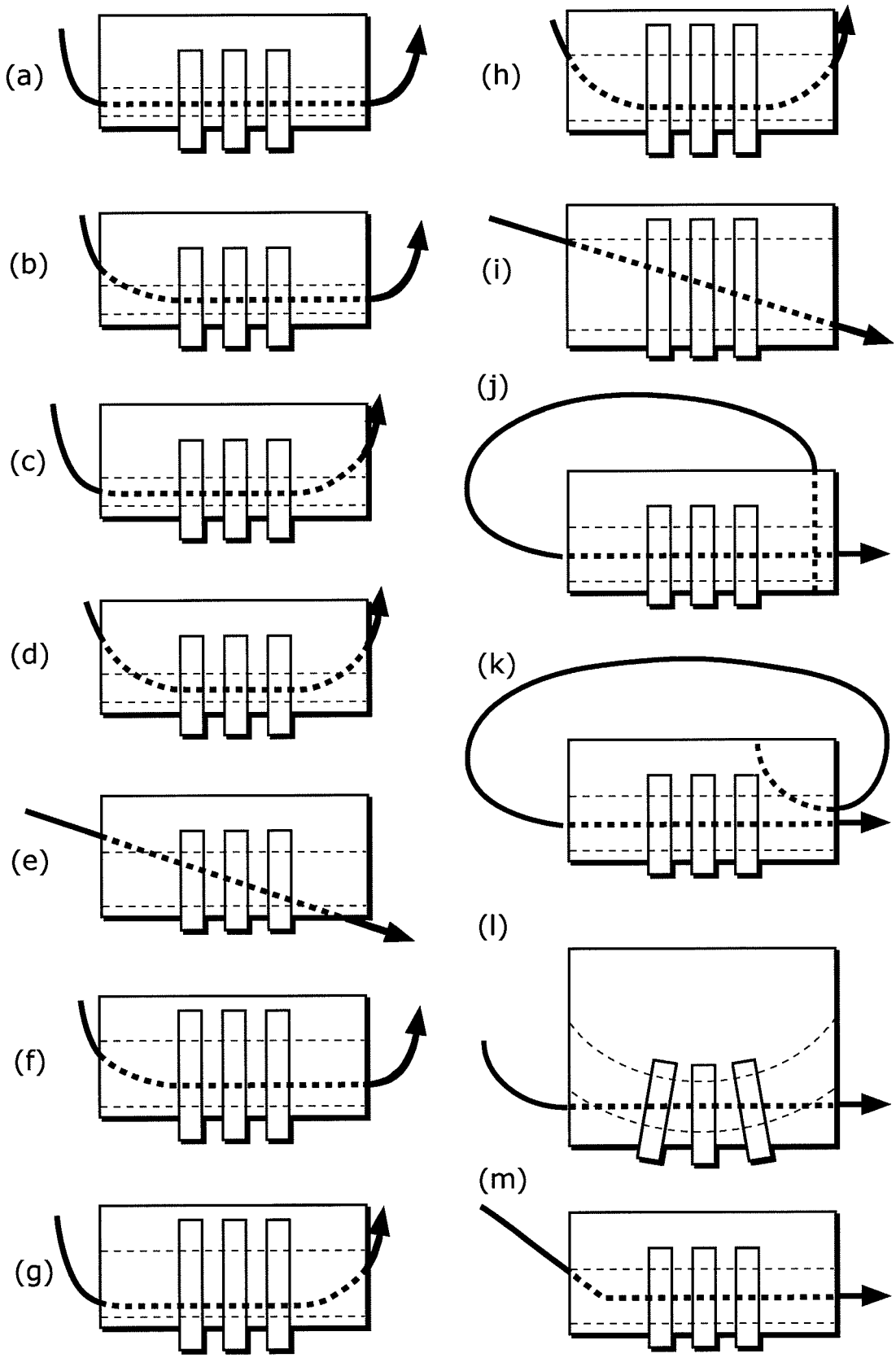
FIG. 12 shows different paths of a band with respect to a shaft from a notch direction of the dial ring and the lock.
Figure 13:
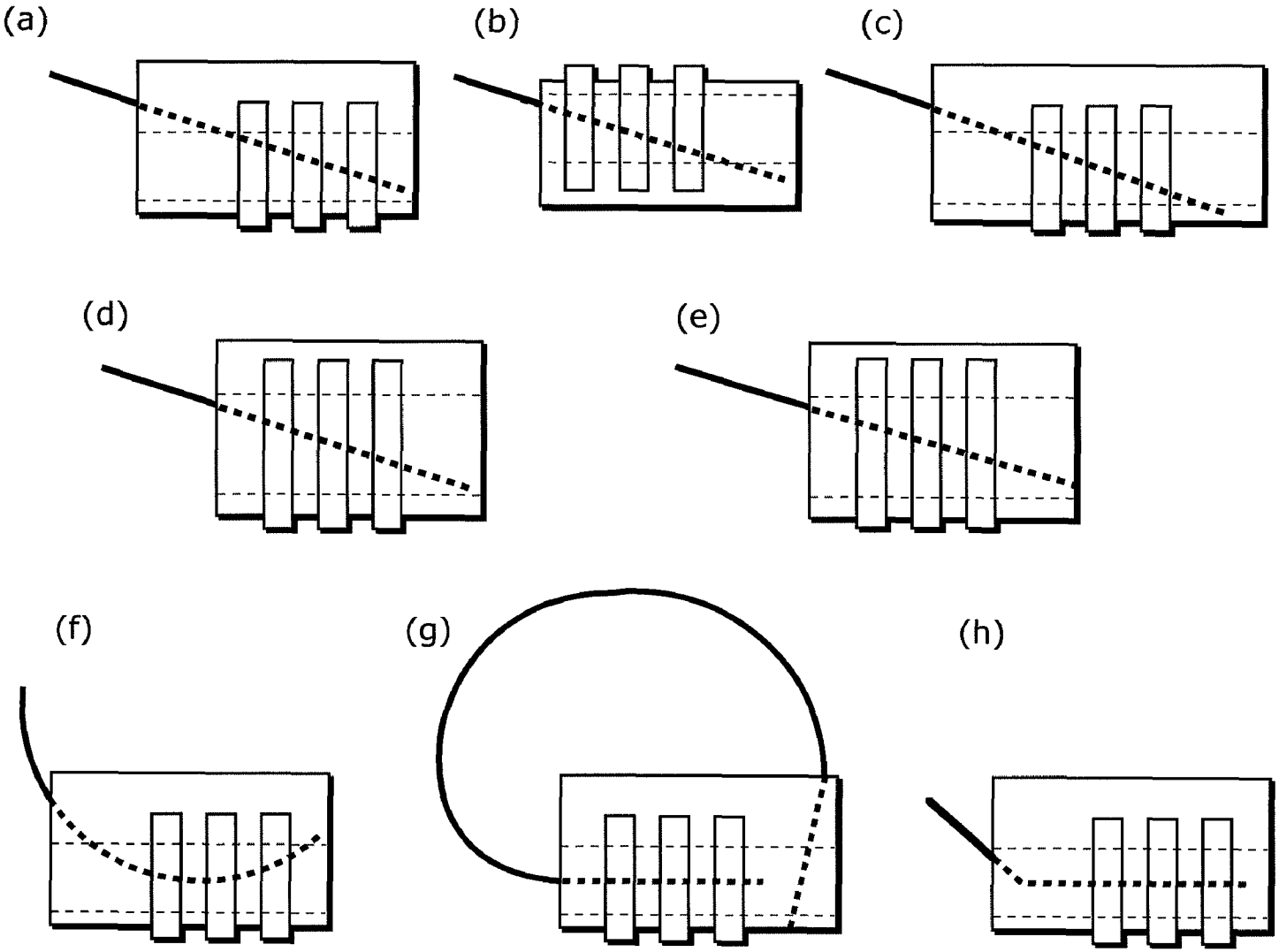
FIG. 13 shows different inserting/removing directions, inserting/removing path of a fixing unit with respect to a shaft of dial lock whose fixing unit is locked in a specific position and positions of the lock.

With reference to FIGS. 12 and 13, examples of dial lock having a structure that the shaft cannot be taken away from the lock body even when the fixing member such as a band is loosely fastened. Note that each of the block diagrams shows the positions of a fixing member such as a band, dial rings, a shaft, and a lock body.

FIG. 12 shows different paths of a fixing member such as a band with respect to a shaft from a notch direction of the dial ring when unlocked. However, description in each diagram will be made using a band as a fixing member. Note that each of the diagrams shown in FIGS. 12(*a*) to 12(*m*) is a top view of the dial lock, and the segment with an arrow denotes a band. In addition, the region between two narrow dotted lines passing through the three dial rings denotes a shaft, and the thick dotted line within the shaft, or the part where the band exist, there is a shaft side groove or shaft side hole to which the band is inserted. More specifically, on the thick dotted line like passing through the three dial rings there is a shaft side groove, and there is a shaft side groove or a shaft side hole on the thick dotted line other than the part. The same applies to FIG. 13 which will be described.

Note that these locking modes may be implemented in a locking device including the lock body 100, the band 400, the three lock dial rings 200 and a shaft in which at least a part of the shaft side groove is formed different from the inserting/removing direction of the lock body. In this case, in the lock body, the body side groove is located so that a passage is formed by the body side groove and the shaft side groove.

FIG. 12 (*a*) shows a dial lock in which the band passes through the shaft in parallel with the shaft direction. For example, the dial lock 1 shown in FIG. 1 is classified into this type.

FIG. 12 (*b*) to FIG. 12 (*e*) each shows a dial lock in which the band passes through the boundary between the lock body and the shaft. In the type of lock shown in FIG. 12 (*b*), the band passes through the lock body once around the bottom of the shaft. In the type of dial lock shown in FIG. 12 (*c*), the band passes through the lock body once around the top of the shaft. In the type of dial lock shown in FIG. 12 (*d*), the band passes through the lock body twice around the top and the bottom of the shaft. In the type of dial lock shown in FIG. 12 (*e*), the band passes through the lock body twice around the top and the bottom of the shaft. In addition, the band comes out on the other side of the side on which the band is inserted with respect to the shaft.

Here, in each of the dial locks shown in FIG. 12 (*b*) to FIG. 12 (*e*), the band passes across the boundary of the shaft and the lock body at least once. In this way, the shaft cannot be removed from the lock body when the band is locked even is the band is loosely fastened.

Furthermore, even if the lock is unlocked when the band ranges the entire shaft side groove, the shaft cannot be removed from the lock body. However, in each of the dial locks shown in FIG. 12 (*b*), FIG. 12 (*d*), and FIG. 12 (*e*), the shaft cannot be removed from the lock body if the band is not completely pulled away from the lock.

FIG. 12 (*f*) to FIG. 12 (*i*) respectively shows a type of dial lock in which the band does not pass across the boundary and the band can move from the edge to the other edge of the shaft (ranging the entire length), and there is a passage which the band pass through.

In the dial lock shown in FIG. 12 (*f*), the band passage is curved around the bottom of the shaft. In the dial lock shown in FIG. 12 (*g*), the band passage is curved around the top of the shaft. In addition, the type of the dial lock shown in FIG. 12 (*h*), the band passage is curved around the top and the bottom of the shaft. The dial lock shown in FIG. 12 (*i*) has a straight band passage which is slanted with respect to the shaft direction.

Here, the direction which the shaft can be inserted to/removed from is a direction toward the shaft hole of the lock body, and is in parallel with the longitudinal direction of the shaft in each diagram. However, in the shaft side groove in the shaft for passing through the band in each of FIG. 12 (*f*) to FIG. 12 (*i*), there is a part which is not parallel with the shaft direction.

Thus if the shaft is removed from the lock body with the band locked, the shaft must be removed while moving the band body located in the part of the shaft side groove which is not in parallel with the shaft direction to the front or the back direction of the lock body, which is vertical to the shaft direction. However, there is a body side groove, facing the shaft side groove, for passing through the band of the lock body in the lock body (For example, see FIG. 5). To put it differently, each of the lock body includes a body side groove along with the dotted line indicating the band in the diagram.

Therefore, even if the band body is brought to move the anteroposterior direction of the lock body, the band body cannot be moved toward the anteroposterior direction of the lock body since a side of the band body with concaves and convexes is in the body side groove. In addition, the shaft side groove needs to be formed in such a manner that the concaves of the band does not protrude from the groove because the dial rings cannot be rotated if the concaves protrude from the groove around the dial rings. However, since the shaft side groove is on the curve of the shaft, the shaft side groove is shallow when the bottom of the shaft side groove is on the same plane and the shaft side groove is not twisted and the concaves of the band body protrude from the groove. Thus unless the band which is curved or is to be curved towards the lower side of the band, and the side opposite to the side with convexes and concaves is used and the shaft side groove is twisted at a predetermined depth, a part of the fixing member which is not a convex protrudes from the shaft side groove, and the part of the fixing member is over the shaft side groove and the body side groove.

Therefore in each of the dial locks shown in FIG. 12 (*f*) to FIG. 12 (*i*), the shaft cannot be removed from the lock body when the band is locked even when the band is loosely fastened.

Furthermore, even if the lock is unlocked when the band ranges the entire shaft side groove, there is a side of the band body including concaves and convexes in a part where the side is not in parallel with the shaft direction of the body side groove.

Therefore, even if the lock is unlocked when the band ranges the entire shaft side groove, the shaft cannot be removed from the lock body. However, the shaft cannot be removed from the lock body if the band is not completely removed from the shaft in FIG. 12 (*f*), FIG. 12 (*h*), and FIG. 12 (*i*).

Therefore, it is possible to manufacture a locking device in which the shaft can be removed only when the lock is unlocked, by shaping a groove or a hole for passing through the shaft and the band of the lock body, regardless of the shape of the shaft as described above. In addition, no additional component for preventing the shaft from being removed from the lock body is necessary.

Figure 15:
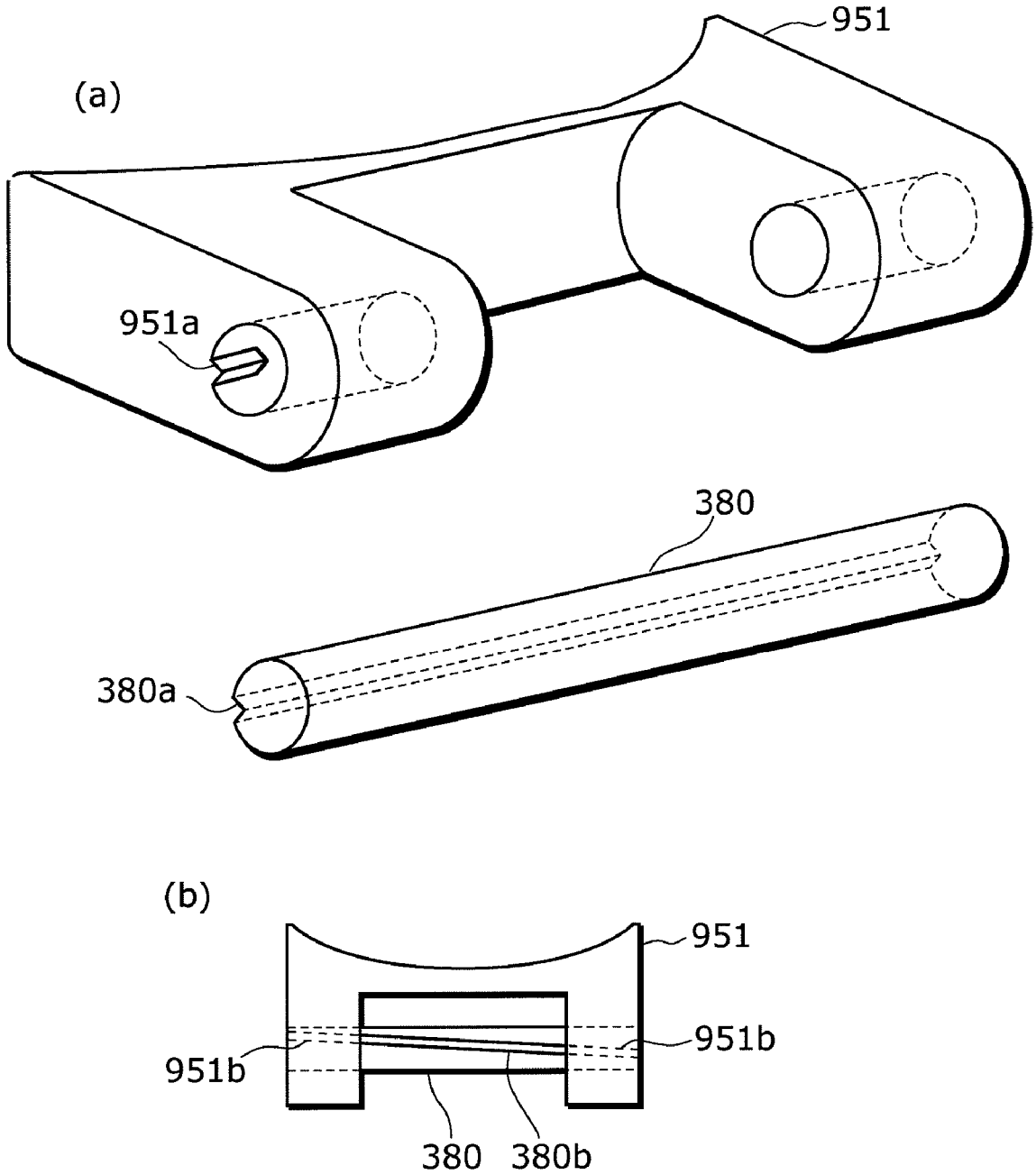
FIG. 15 shows a schematic view of a shaft which prevents a rotation against the lock and which can be inserted and removed from both left and right of the lock, the lock, and a shaft side band groove on the shaft.

For example, if the shaft, as will be described in FIG. 15, is a cylinder and can be inserted/removed from both side of the lock body is used the locking device according to the present embodiment can be made disassembled only when the lock is unlocked by forming a passage for the band as shown in FIG. 12 (*b*) to FIG. 12 (*i*).

Note that the dial locks shown in FIG. 12 (*b*), FIG. 12 (*d*), and FIG. 12 (*f*), FIG. 12 (*h*), the force toward the band can be distributed since more area of the band, the shaft, and the lock body contact in the curve when locking an umbrella and the like with the band.

FIG. 12 (*j*) and FIG. 12 (*k*) show a type of dial locks which has another shaft side groove (hereinafter referred to as "sub shaft side groove") in addition to the shaft side groove for fixing the band with the dial rings. Note that the two shaft side grooves in each of the dial locks doe not cross.

Note that the shaft side groove for fixing the band with the dial rings is the groove on the thick line passing through the three dial rings within the shaft in the diagrams as described above, and sub shaft side groove is on the rest of the thick like within the shaft. Here, the part in which the band is to be inserted, other than the shaft side groove for fixing the band with dial rings may be a hole, not a groove. In this case, for example, in FIG. 12 (*j*), the shaft side groove which passes through the three dial rings and a shaft side hole which does not pass the three dial rings.

The shaft side groove which does not pass through the three dial rings, or the sub shaft side groove and the shaft side groove described above, has the same effect in that The dial lock shown in FIG. 12 (*j*), the fixing member passes through the shaft twice while twisted. In addition, the dial lock shown in FIG. 12 (*k*), the fixing member can cross the shaft by having the sub shaft side groove on the shaft, not twisted with the shaft side groove for fixing the band with the dial rings.

The sub shaft side grooves of the dial locks shown in FIG. 12 (*j*) and FIG. 12 (*k*), are formed on a direction which is different from the inserting/removing direction of the shaft with respect to the lock body. Thus, the band passage is formed in a direction which is different from the inserting/removing direction of the shaft is locked to the lock body with the band on the sub shaft side groove.

FIG. 12 (*l*) shows a dial lock in which the straight band passes through the curved shaft.

In the dial lock shown in FIG. 12 (*l*), the inserting/removing direction of the shaft with respect to the lock body is on the curve along with the curve of the shaft. Meanwhile, the band passes through the shaft in a straight line. Thus, the band passage of the dial lock shown in FIG. 12 (*l*) is formed in a direction which is different from the inserting/removing direction of the shaft with respect to the lock body. Therefore, the shaft is locked by the band.

To put it differently, as shown in FIG. 12 (*b*) to FIG. 12 (*e*) and FIG. 12 (*j*) to FIG. 12 (*l*), the passage for fixing member crosses the boundary of the lock body and the shaft in the direction which is different from the inserting/removing direction of the shaft with respect to the lock body at the shaft side face, and when the fixing member is on the crossing part, the shaft cannot be pulled out from the lock body whether there is the body side groove or not.

In addition, as shown in FIG. 12 (*f*) to FIG. 12 (*i*) and FIG. 12 (*m*), even when the passage for fixing member does not cross the boundary of the lock body and the shaft in the shaft side position, by forming a part of the hole or the opening formed with the shaft side groove and the body side groove, to a direction different from the inserting/withdrawing direction of the shaft to the lock body when there is a body side groove, the fixing member in the shaft side groove part, which is formed to a direction different from the inserting/withdrawing direction of the shaft is placed over the body side groove, or the fixing member over the shaft side groove part of the withdrawing side of the shaft from the shaft side groove part formed to a direction different from the inserting/withdrawing direction of the shaft. With this, the shaft cannot be withdrawn from the lock body.

FIG. 12 (*m*) shows a dial lock in which the band passes through the curved shaft by flexing a part of the band.

In summary, in the dial lock shown in FIG. 12 (*m*), a part of the band passage is formed in a direction which is different from the inserting/removing direction of the shaft with respect to the lock body. Even in this case, if the band is over the shaft side groove and the body side groove on the bended part, the shaft is to be locked with the band.

In addition, if there is a groove or a hole in which the fixing member passes through on the shaft side as shown in FIG. 12 (*j*), FIG. 12 (*k*), or FIG. 13 (*g*) which is to be described, the fixing member can be locked with the lock body in such a manner that the shaft member does not rotate, and thus the direction of the fixing member with respect to the lock body can be determined by the shaft side groove. In addition, the convexes and concaves of the fixing member are fixed by the dial rings, and thus the lock body is not directly involved. For this reason, the body side groove is not necessarily for the structure of the dial lock.

In addition, without the deformability of the fixing member, the shaft member cannot be removed from the lock body if the fixing member is locked with the dial rings when there is a part which is different from the removing direction of the shaft member within, for example, the range of the dial rings on the shaft side groove.

Therefore, a locking device which can be disassembled/assembled only when the lock is unlocked by changing the shape of the shaft of the shaft side groove or the shaft side hole which is the minimum component for the passage of fixing member.

More specifically, at least a part of the shaft side groove or the shaft side hole forming the passage for the fixing member is formed in a direction which is different from the inserting/removing direction of the shaft member with respect to the lock body, and the passage of the fixing member crosses the shaft member on the shaft side. Thus the shaft member of the dial rings are locked to the lock body when the fixing member is locked with the dial rings, even if the shaft side groove passes through the shaft member. Furthermore, this structure enables unlocking of the shaft member with respect to the lock body by unlocking the fixing member with respect to the dial rings and removing the fixing member from the shaft side groove of the shaft side hole.

In addition, when there is the body side groove, at least a part of the hole of an opening formed with the shaft side groove and the body side groove is formed in a direction which is different from the inserting/removing direction of the shaft member with respect to the lock body, and the fixing member on the shaft side groove part formed to a direction different from the inserting/withdrawing direction of the shaft member is over the body side groove or the fixing member on the shaft side groove part further on the side of the withdrawing the shaft member than the shaft side groove part formed to a direction different from the inserting/withdrawing direction of the shaft member is over the body side groove. Thus, the shaft member cannot be withdrawn. Thus, with a simple structure such as the body side groove, a safe locking device which cannot be disassembled when locked, without having the fixing member passage crossing the shaft member on the shaft side.

In addition, in the locking device according to this embodiment, the part of the fixing member such as a band which is fixed with the lock dial rings (hereinafter referred to as "fixing unit") may not pass through the shaft or the lock body.

The structure which enables unlocking the lock only when unlocked in a locking device in which the fixing unit of the fixing member does not pass through the lock body is described with reference to FIG. 13.

FIG. 13 shows different band passages of the dial lock, with respect to the shaft and the lock body in which the fixing unit of the fixing member does not pass through the lock body. Note that each of FIG. 13 (*a*) to FIG. 13 (*h*) shows a top view of the dial lock and shows a lock from a direction where the cutout of the dial rings when unlocked, and the thick line in the shaft or the lock body indicates fixing member.

In the dial lock shown in FIG. 13 (*a*) and FIG. 13 (*b*), the fixing unit crosses the boundary of the shaft and the lock body in one part. In addition, in the type of lock shown in FIG. 13 (*a*), the fixing unit does not pass through the shaft, and in the type shown in FIG. 13 (*b*), the fixing unit passes through the shaft. In the type shown in FIG. 13 (*c*), the fixing unit passes through the boundary of the shaft and the lock body in two points. In addition, the fixing unit passes through the shaft.

Note that the part where the top of the fixing unit of the fixing member is inserted before or after crossing the boundary of the shaft and the lock body is referred to as an inserting unit. In addition, inserting unit is in a part which is continuous to the edge of the shaft side groove on the shaft circle.

In the dial locks shown in FIG. 13 (*a*) to FIG. 13 (*c*), the boundary of the shaft and the lock body in at lease one point as well as the type shown in FIG. 12 (*b*) and others. To put is differently, the fixing unit is over the shaft side groove and the inserting unit continuous to the shaft side groove. Thus, the shaft cannot be removed from the lock body when the lock is locked. In addition, the shaft cannot be removed from the lock body when the fixing unit is not completely removed from the shaft even if the lock is unlocked.

In the dial locks shown in FIG. 13 (*d*) and FIG. 13 (*e*), the fixing unit is on the shaft side groove and the body side groove, not just in the lock body. In addition, in the type of lock shown in FIG. 13 (*d*), the fixing unit does not pass through the shaft, and in the type shown in FIG. 13 (*e*), the fixing unit passes through the shaft.

The dial locks shown in FIG. 13 (*d*) and FIG. 13 (*e*), as well as the type of lock shown in FIG. 12 (*f*) and others, the shaft side groove and the body side groove is not in parallel with the shaft direction. In addition, since the fixing member ranges over the shaft side groove and the body side groove, the shaft cannot be removed from the lock body when the lock is locked. In addition, the shaft cannot be removed from the lock body when the fixing unit is not completely removed from the shaft even if the lock is unlocked.

The structure which enables unlocking the lock only when unlocked in a locking device in which the fixing unit of the fixing member does not pass through the lock body as described above. To put it differently, unlike the dial lock 1 which is locked at any position of the fixing member, the locking device which locks the fixing member at a predetermined position may be able to disassembled/assembled only when the lock is unlocked, by adopting the dial lock structure shown in FIG. 13 (*a*) to FIG. 13 (*e*).

In addition, if the fixing unit of the fixing member is not straight like the lock in FIG. 13 (*a*) to FIG. 13 (*e*), the locking device which can be disassembled/assembled when the lock is unlocked.

FIG. 13 (*f*) shows a dial lock with a curved passage for fixing member. More specifically, with the curved shaft side groove which is fixed at a specific position, the fixing unit of the fixing member is inserted while being curved, and the tip of the fixing unit is inserted to the lock body.

FIG. 13 (*g*) shows a dial lock in which the fixing member passes through the shaft at a point other than the shaft side groove for fixing the fixing unit with the dial rings.

The dial lock shown in FIG. 13 (*h*) is a dial lock the passage which in which the fixing unit of the fixing member does not pass through the shaft.

To put it differently, the dial locks shown in FIG. 13 (*f*) to FIG. 13 (*h*), at least a part of the shaft side groove and the shaft side hole forming a passage for the fixing member is formed in a direction which is different from the inserting/removing direction of the shaft member. Therefore, each of the dial locks shown in FIG. 13 (*f*) to FIG. 13 (*h*) has a structure that the shaft member can be unlocked with respect to the lock body when the fixing member is removed from the shaft side groove or the shaft side hole.

Note that each type of the dial locks shown in FIG. 12 (*b*) to FIG. 12 (*m*) and FIG. 13 (*a*) to FIG. 13 (*h*), a part of, or all of fixing unit in the shaft is not in parallel with the shaft direction. Thus, when the lock is locked, the shaft cannot be removed from the lock body even when the special member restricting the movement of the shaft when locked, and the locking device can be disassembled only when unlocked. In addition, the component for preventing the shaft from taken off the lock body, and thus the lock can be easily assembled after the lock is disassembled.

In addition, the lock body 100 of the dial lock 1 shown in FIG. 5 includes three dial ring setting units 105, each of which is attached with the shaft 300. However, the spaces may be combined.

Figure 14:
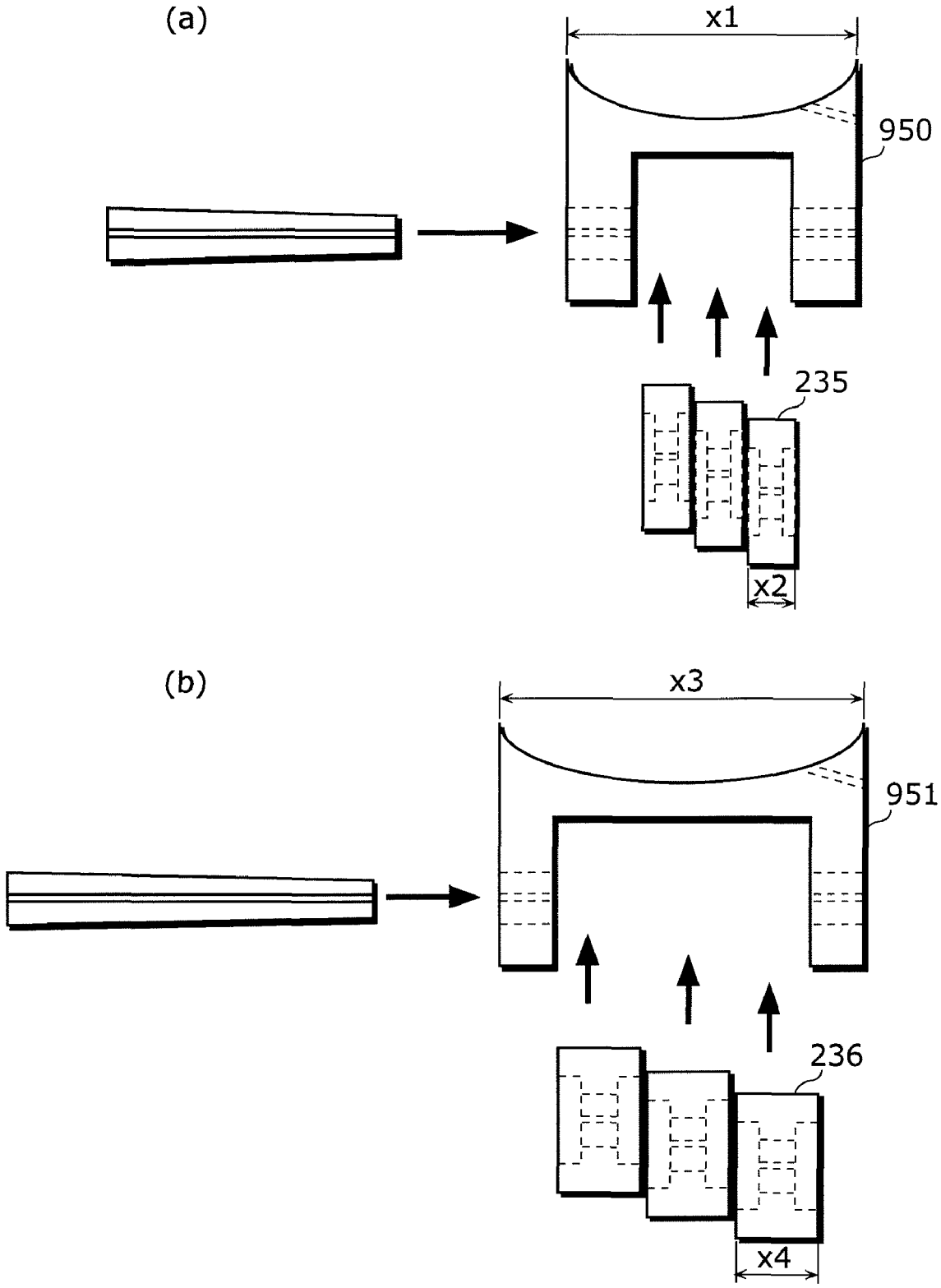
FIG. 14 shows two examples of the lock bodies, each of which has a space for dial rings.

FIG. 14 shows examples of the lock body with a space for attaching dial rings. As shown in FIG. 14 (*a*), the lock dial rings 235 can be attached to the lock body 950 while contacting the lock body 950. For example, if the width of the lock dial rings 235 (×2) is to be the same width as the lock dial rings 200 as shown in FIG. 5, the width of the lock body 950 (×1) can be made shorter than the length of the lock body 100 in the shaft direction as shown in FIG. 5. In this case, the inner width of the lock dial rings 235 is made shorter than the outer width. To put it differently, inner recess is provided on the side of the lock dial rings 200 which is a flat part. Furthermore, the pitch of the convexes and concaves of the band to be used may be adjusted to the pitch of inner concaves and convexes of the lock dial rings 235, which is formed when the lock dial rings 235 are arranged. With this, it is possible to provide, for example, a smaller dial lock. Note that, in FIG. 14 (*a*), the inner recess is the part excluding the ring side shaft hole and the ring side band groove in the broken line drawn in the dial rings 235. When the band convexes are in the inner recess of the dial ring 235, the dial rings 235 are rotatable centering the shaft.

FIG. 14 (*b*) shows an example of the lock body with a space for attaching dial rings. As shown in FIG. 14 (*b*), the width of the lock body 951 (×3), for example, the same as the length of the lock body 100 in shaft direction, the width of the lock dial ring 236 (×4) can be wider than the width of the lock dial ring 200 shown in FIG. 5.

Widening the width of the dial ring facilitates engraving and printing on the surface.

In addition, in the lock body which can be attached while contacting with the dial rings, by providing dial rings with various lengths and bands with band body having concaves and convexes adjusted to the width of the dial rings, the user of the dial lock can freely change the dial rings to double, triple, and quadruple.

In addition, even in the lock body with a space for attaching the dial rings, due to the spatial relationship of the band, shaft, and the lock body as shown in FIG. 12 (*b*) to FIG. 12 (*k*), and FIG. 12 (*m*), it is possible to construct a dial lock in which the shaft cannot be removed even when the band is loosely fastened.

FIG. 15 (*a*) shows an overview of the lock body 951 and the shaft 380 with one space for attaching the dial ring. As shown in FIG. 15 (*a*), the lock body 951 includes a guide 951*a* for fixing the shaft in a circumferential direction. In addition, the shaft 380 is a cylinder as a whole, and has a guide groove 380*a* which corresponds to the 951*a* in the shaft direction. Note that the lock body side band groove in the lock body 951 and the shaft side band groove in the shaft 380 are omitted in the diagram for simplifying the illustration.

Since the guide groove 380*a* of the shaft 380 ranges from the shaft width direction, the shaft can be inserted and removed from both left and right of the lock body 951. In addition, this applies to the case where there are multiple spaces for attaching the dial rings. However, as shown in FIG. 15 (*b*), when the shaft 380 and the lock body 951 are provided such that the shaft side band groove 380*b* and the lock body side band groove 951*b* is not in parallel in the shaft direction, or, when the band passes the lock as in the band passage shown in FIG. 12 (*b*) to FIG. 12 (*i*), the shaft cannot be removed to the left or the right of the lock body even if the band is loosely fastened when locked, as described above. Furthermore, even if the lock is unlocked, when the band is not removed from the shaft 380, the shaft cannot be removed to the left or the right of the lock body.

As described above, even when the lock body with a space for attaching the dial rings, it is possible to assemble a locking device which can be repeatedly reassembled without using a component for preventing the shaft being removed from the lock body.

In addition, it has been noted that when locking an umbrella using a dial lock, a bump can be formed in a part of the closed umbrella using an attachment having a donut disc shape. However, the attachment may not take the shape of disc.

Figure 16:
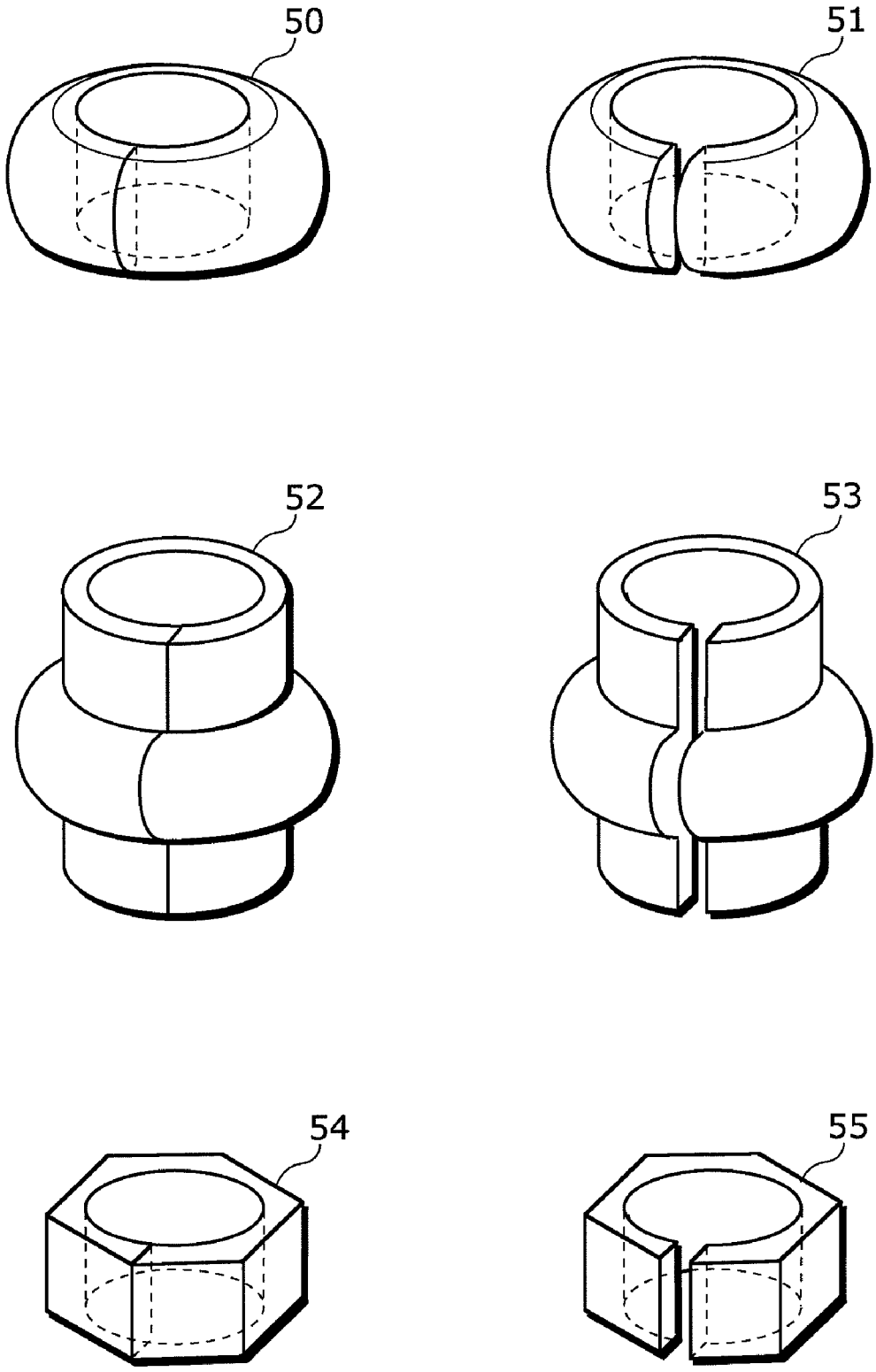
FIG. 16 shows examples of attachments.

FIG. 16 shows examples of attachments. Note that each of the attachment shown below is an example of a large diameter part member.

One of attachments 50 to the attachments 55 shown in FIG. 16 is attached in a part of tube of an umbrella between the runner and the ferrule so that the tube is set to the center of the attachment. With this, a bump can be created between the runner and the ferrule of the closed umbrella. Consequently, a part where the cross-sectional outside diameter vertical to the tube is narrower than above and below can be created between the runner and the ferrule of the closed umbrella. By locking the narrowing part with the dial lock while fastening with the band, the dial lock cannot be removed to the vertical direction of the umbrella. In addition, in the case where the outside diameter of the cross section vertical to the tube in the runner is not as large as other part of the umbrella, and in the case where the band is subject to be removed even if the band is fastened, the band is fastened using multiple attachments in the narrowing part of the umbrella between the attachments.

The attachment 50 takes a shape of a donut with a cutout for attaching the attachment 50 to the tube of an umbrella. The attachment 51 has a shape for easily attaching the attachment to the tube of an umbrella.

The attachment 50 takes a shape of a cylinder with a bump with a cutout for attaching the attachment 52 to the tube of an umbrella. The attachment 53 has a cutout to the attachment 52 for easily attaching the attachment to the tube of an umbrella. In addition, the bump of the attachment 52 or the attachment 53 may not only be one, but two above and below. In that case, the lock can be locked by fastening the band on the part between the two bumps on the umbrella.

The attachments 50 to 53 look like circles as a whole when viewed from top. However, the attachment may take a polygonal shape formed with straight lines when viewed from top.

The attachment 54, is a hexagon when viewed from top, and the attachment 55 takes a shape of the attachment 54 with a cutout so as to facilitate the attachment to an umbrella tube.

In addition, the center of the attachment may not be formed with a curve and may take any shape as long as the tube can be attached to the center of the attachment.

Figure 17:
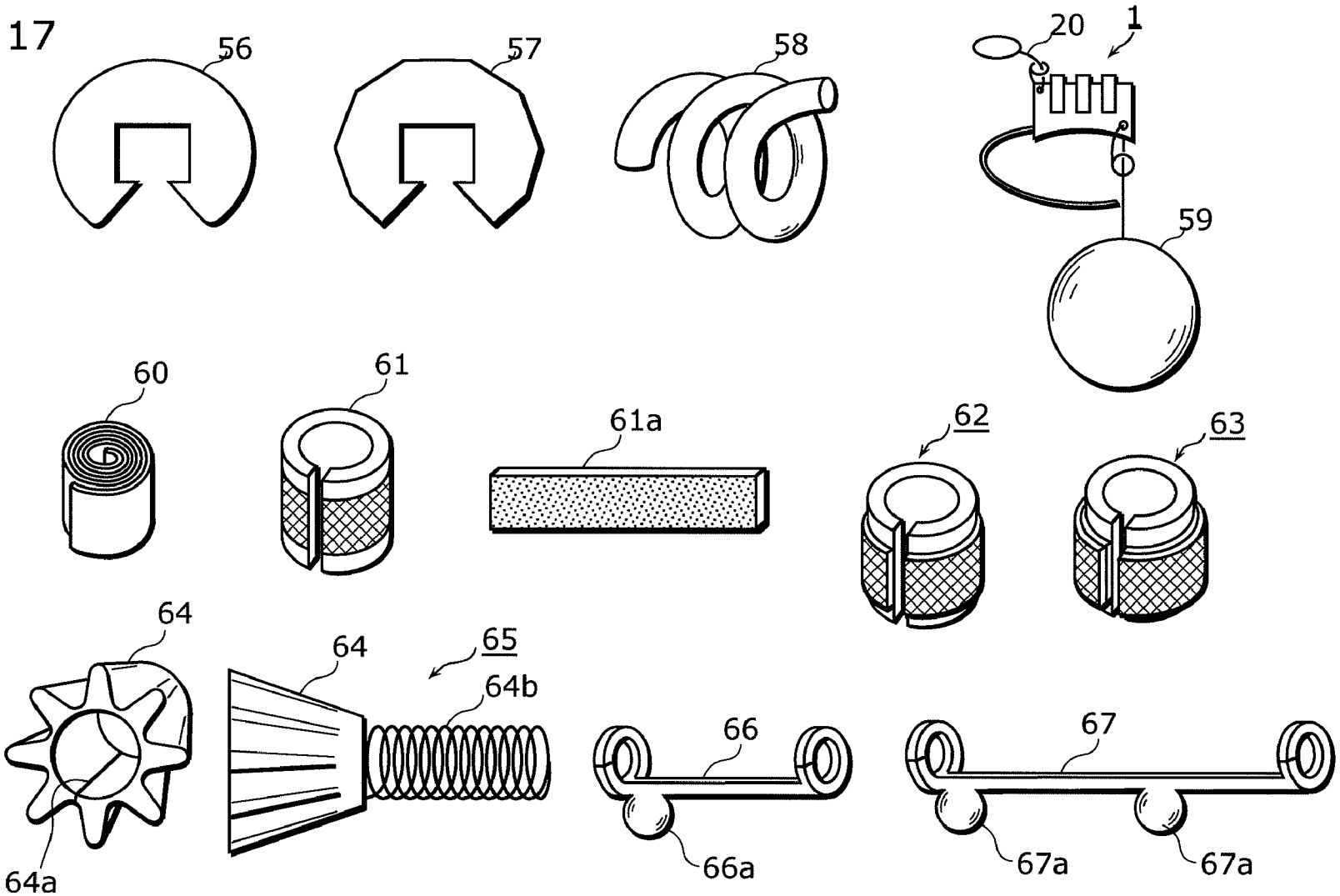
FIG. 17 shows other examples of attachments.

FIG. 17 shows other examples of attachments. The attachment 56 and the attachment 57 shown in FIG. 17 are illustrated from top. The center of the attachment 56 is formed with straight lines. In addition, the cutout is open to outside so as to facilitate attaching the attachment to the umbrella tube. The center of the attachment 57 takes the same shape of the center of the attachment 56, and the outer circumferential shape is formed with straight lines.

The attachment 60 is a spiral attachment made of elastic material, for example plastic, and the umbrella tube and the like can be inserted to the center of the spiral from the end. In addition, the outside diameter can be adjusted by cutting the attachment at a suitable position. The attachment 61 has hooks of a hook-and-loop fastener, and can be connected with a band member 61*a* which has loops of the hook-and-loop fastener. Note that, in FIG. 17, the shaded part on the surface of the attachment 61 shows hooks, while the dotted part on the band member 61*a* shows loops. The hooks and loops may be switched. In addition, the band member 61*a* has hooks on the back.

The attachment 62 is formed by attaching the band member 61*a* around the attachment 61. In addition, when the band member 61*a* is attached, hooks on the back of the band member 61*a* appear on the surface. Another band member 61*a* can be attached around the band member 61*a*. The attachment 63 is an attachment on which two band members 61*a* are attached in layers. As described above, the outside diameter can be adjusted by layering multiple band member 61*a*.

The attachment 64 is an attachment with dents around the circle. When an umbrella is closed with the umbrella tube is set in the hole of attachment 64 from the slit 64*a*, each of the ribs of the umbrella set in the dents even is the attachment 64 is located on the ferrule side. Thus, the attachment 64 is less likely to cause stress to the ribs of the umbrella. Thus, the attachment 64 can form a large diameter part in an umbrella.

In addition, if the part to which the attachment 64 is attached is too close to the ferrule, the attachment cause stress to the ribs when the umbrella is closed even if the attachment has dents. Thus, for example, it is possible to attach a spring to the attachment 64.

The attachment 65 is the attachment 64 with the spring 64*b* attached to a part facing toward the ferrule. By adjusting the length of the spring, the attachment 64 can be set so that the attachment 64 is placed in a position where it is suitable for locking without causing much stress to the umbrella. Furthermore, the runner approaches the ferrule when opening the umbrella, shrinking the spring 64*b* prevents the umbrella from not opening completely.

The attachment 66 is an attachment with the sphere 66*a*, and the attachment 67 is an attachment with two spheres 67*a*. They respectively include rings with slits at the both ends. The attachment can be attached to an umbrella by inserting the umbrella tube, a rib, or a stretcher to the two rings.

When the attachment 66 is used, it is possible to form a large diameter part in an umbrella with the sphere 66*a*. When the attachment 67 is used, two large diameter parts are formed in the umbrella. Thus, when the attachment 67 is used, a part between the large diameter parts of the umbrella in which the outside diameter of a cross section vertical to the longitudinal direction is smaller than the upper part and the lower part with the attachment exists on the attachment 67. In other words, when the attachment 67 is used, the fixing member such as a band and others are attached is on the attachment 67 with the umbrella fabric in between.

Since the attachment 67 includes two spheres 67*a*, the part between the large diameter part can always be formed.

Note that, the large diameter part forming member may not be a ring with a slit or a cutout such as the attachment 50 to 57, and may be a spring like a spring such as the attachment 58. If the large diameter part forming member is made of a material such as rubber and elastic metal, it can be attached to the tube of an umbrella.

In addition, the attachment may be attached to the rib, instead of the tube. A meaningful large diameter part may be formed by attaching the attachment to the part of the umbrella rib between the runner and the ferrule when the umbrella is closed. Furthermore, attaching the attachment between the joint of the rib connecting the stretcher has the same effect to attaching the attachment to the tube since the attachment cannot be removed when the umbrella is closed. Especially when there are two bumps in an attachment, the attachment increases in length, and in the case where the attachment is attached to the tube, there is a possibility that the attachment interferes opening/closing the umbrella. However, if the attachment is attached to the rib, it should be of no problem.

In addition, the attachment may be attached to the stretcher, in stead of the tube or rib of the umbrella. In essence, the attachment may be attached to any part which is inside the umbrella fabric when the umbrella is closed, in a part where the attachment cannot be removed to outside when locked, and where a large diameter part can be formed in the umbrella. In addition, when the attachment is attached to the tube and others, the space such as a hole for attaching the attachment may have a size or a shape that a tube and the like may be passed.

In addition, the attachment may not have a space for being attached to the umbrella tube as long as a bump can be formed in a closed umbrella. The attachment 59 is a spherical object, and may have a size with which an umbrella can be closed when the attachment is in a part between the runner and the ferrule of the umbrella.

In addition, connecting the attachment to the dial lock 1 with a wire prevents the attachment from being lost.

Note that in FIG. 17, a diagram showing the attachment 59 connected to the dial lock 1 with wire, however, the diagram does not show a ratio of the size of the dial lock 1 and the attachment 59.

As described above, the attachment which is an example of the large diameter forming member can be designed freely as long as an umbrella can be closed and a bump is created in a part of the closed umbrella when attached to the umbrella.

In addition, the attachment may also be effective when used in combination with a locking device other than a dial lock, namely, a cylinder lock, a card lock and the like. The locking device may lock an umbrella by fastening externally.

In addition, it is easy to manufacture an umbrella, in which an attachment such as the attachment 64 or the attachment 65 is incorporated in advance. A bump such as the attachment 66 or the attachment 67 may also be easily created. If the joint part connecting the ribs and the stretchers is fully expanded, a large diameter part effective for locking can be created.

In addition, an object may be locked with two dial locks by providing a hole for passing through a band body of the other lock in a dial lock.

Figure 18A:
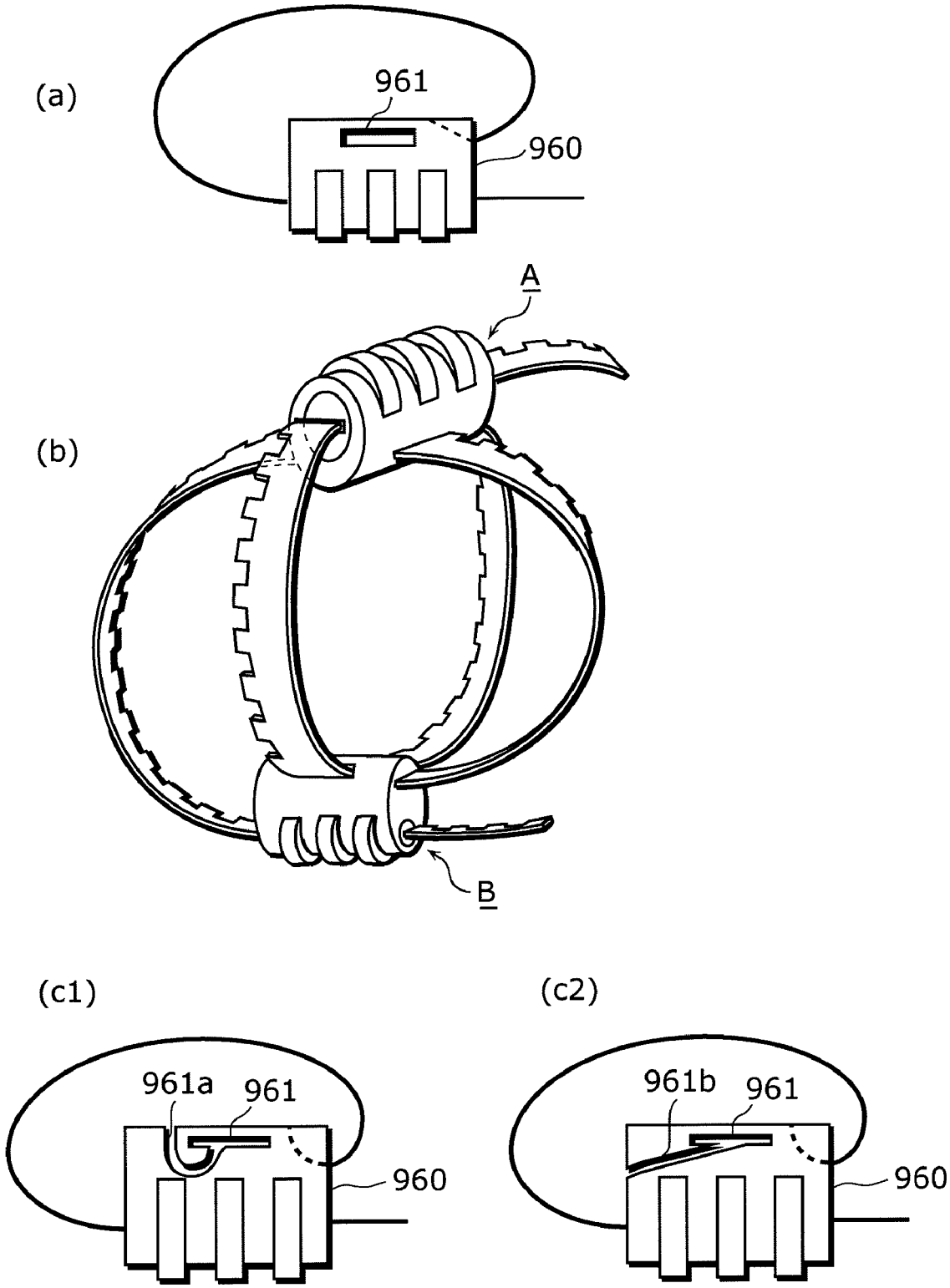
FIG. 18A shows a dial lock having a lock body provided with a hole or a groove to which the band of lock passes through, and a locking method of locking an object by crossing two of the dial lock.

FIG. 18A (a) shows a dial lock using a lock body having a hole for passing through the band body of the other dial lock.

As shown in FIG. 18A (a), the lock body 960 includes a connecting hole 961. The connecting hole 961 is a hole for connecting the dial lock with the other dial lock by passing through the band body of the other dial lock.

FIG. 18A (b) is a diagram showing a method for locking an object using two dial locks shown in FIG. 18A (a). In the diagram, the band body of the dial lock B passes through the connecting hole of the dial lock A, and the band body of the dial lock A passes through the connecting hole of the dial lock B. The fastening method of an object shown in FIG. 18A (b) may be implemented by using a fastening band and the like. More specifically, by providing, in two fastening bands and the like, a hole through which the band can pass through, and providing another connecting hole through which the band part of the other fastening band and the like, an object can be fastened in the manner shown in FIG. 18A (b). That is to say, a method in which an object is fastened with two tools having a hole which can fix its own band or a rope and a connecting hole for passing through the other band or a rope-like material can be considered as a method in which an object of which the fastened part tends to dent, newspaper or magazines, for example, is less likely to loosen after they are fastened.

Furthermore, it is possible to include a function in which the band part can pass through (or move) only one direction, in the connecting hole other than the hole through which the own band part pass. In this way, even the connecting hole part can only move to one direction when tightly fastened without laxity as shown in FIG. 18A (b). Thus a method is useful to fasten the object so that the band part of the other band stops moving at a convex even when the other band moves at the connecting hole part while taking the concave-convex form of the object when the fastening object is solid and the band part does not break into the object.

As shown in FIG. 18A (b), an object can be locked by fastening the object from front, back, left, right, top, and bottom with the bands of two dial locks. For example, a personal diary, a book, a file of which would not like to be seen can be locked.

Note that, in FIG. 18A (a) and FIG. 18A (b), the connecting hole is provided in the lock body in such a manner that the hole vertically passes through with respect to the shaft direction of the lock body. However, the connecting hole may be provided in the lock body so that the hole passes through in an angle not in parallel with respect to the shaft direction of the lock body. The angle may be determined in accordance with the size or the shape of the object to be locked.

In addition, a connecting groove, not a connecting hole may be included in order to connect other locking devices.

FIG. 18A (c1) is a diagram showing an example of the lock body with a connecting groove. FIG. 18A (c2) is an example showing another example of the lock body with a connecting groove.

The lock body 960 shown in FIG. 18A (c1) has a shape that the lock body 960 shown in FIG. 18A (a) is provided with the groove 961*a* which reaches the connecting hole 961 from outside. More specifically, a connecting groove for connecting other locking device is formed with the connecting hole 961 and the groove 961*a*. In addition, in the lock body 960 shown in FIG. 18A (c2), a connecting groove for connecting other locking device is formed with the connecting hole 961 and the groove 961*b* in the same manner.

To the lock body 960 shown in FIG. 18A (c1), a fixing member such as a band or the like of other locking device is inserted to the connecting groove from the back of the lock body. In addition, to the lock body 960 shown in FIG. 18A (c2), a fixing member such as a band or the like of other locking device is inserted to the connecting groove from the side of the lock body.

More specifically, the locking device including the lock body shown in FIG. 18A (c1) or FIG. 18A (c2) can passes a fixing member such as a band or the like of other locking device through the connecting groove even when the other locking device is locking an object. In other words, it is not necessary to connect two locking device being crossed each other in advance. Instead, one of the locking device can be pre-locked in advance, and the locking device with connecting groove can be connected to lock the device, and each of the locking device can be appropriately fastened before locking. Thus, it is possible to change an order for locking the device in a crossed manner.

In addition, the locking method which locks an object in a crossed manner as shown in FIG. 18A (b), can fasten the object easily and effectively by, applying a method for fastening the object in a crossed manner, while using two fasteners for fastening the object for example. In addition, by applying the structure of the locking device for locking an object in a crossed manner, a fastener for easy and effective fastening can be manufactured.

Note that the fastener includes a fixing member which takes a lengthy shape and a fixing component for fixing the fixing member.

Figure 18B:
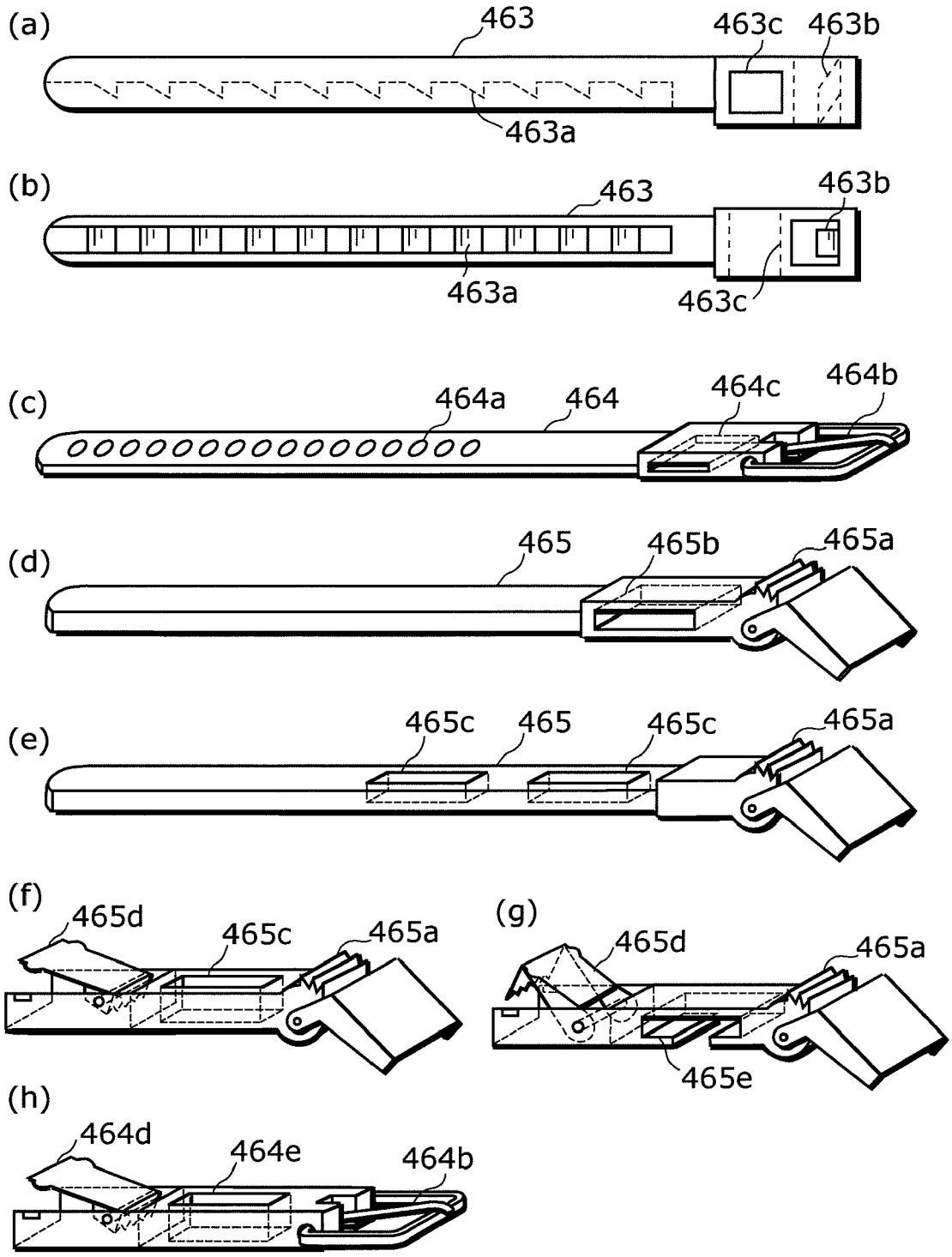
FIG. 18B shows an example of a fastener for fastening an object by crossing the fasteners, and their components.

FIG. 18B shows an example of fasteners, which fastens an object by crossing the fasteners, and their components.

FIG. 18B (a) is a diagram which shows a schematic structure of the fastening band 463 for fastening an object by crossing the bands. FIG. 18B (b) is a bottom view showing a schematic structure of the fastening band 463. A band used as a fixing member is referred to as fastening band.

As shown in FIG. 18B (a) and FIG. 18B (b), the fastening band 463 includes the connecting hole 463*c* for connecting other fastener, the convexes 463*a* and the click 463*b* which engages with the convex 463*a*. The click 463*b* is provided in the hole for passing through the band. The part in which the hole including the clicks 463*b* inside is a fixing component in the fastening band 463.

The fastening band 463 is inserted to a hole in which the clicks 463 is provided, and when the convexes 463*a* engages with the click 463*b*, the band part cannot be removed from the hole in which the click 463*b* is provided.

FIG. 18B (c) is a diagram showing a schematic structure of the fastening belt 464 for fastening an object by crossing the belts. A belt used as a fixing member is referred to as fastening belt. As shown in FIG. 18B (c), the fastening belt 464 includes the connecting hole 464*c*, holes 464*a*, the fixing part 464*b* which is a part for fixing the belt part including the hole 464*a* by inserting the fixing member to the hole 464*a*. More specifically, the fastening belt 464 has a structure which includes the connecting hole 464*c*, in addition to the structure used for clothing. In addition, the buckle including the fixing part 464*b* is the fixing component in the fastening belt 464.

FIG. 18B (d) is a diagram showing a schematic structure of the fastening belt 465 for fastening an object by crossing the belts. As shown in FIG. 18B (d), the fastening belt 465 includes the connecting hole 465*b*, the fixing part 465*a* which fixing the belt part by interposing. The fastening belt 465 has a structure including the connecting hole 465*b* in addition to the structure of the belt used for clothing. In addition, the buckle part where the fixing part 465*a* is provided is the fixing component in the fastening belt 465.

FIG. 18B (e) shows a schematic structure of the fastening belt in which connecting holes are provided to the fastening belt 465 shown in FIG. 18B (d). Practically, the belt part can be loner. The fastening belt 465 shown in FIG. 18B (e) includes two connecting holes 465*c*. The direction of the connecting hole in a fastener such as fastening belt or the like as shown in FIG. 18B (d) is substantially vertical the longitudinal direction of the fastener and the direction is vertical to the plane including a circle formed by the fastener when fastening the object. Meanwhile, the direction of the connecting hole 465*c* is substantially vertical to the longitudinal direction of the fastener, and parallel with the plane including a circle formed by the fastener when fastening the object. Here, in the fastener, the belt part, the band part, and the fastening band and others are flexible enough to fasten an object. Thus, even if the connecting hole 465*c* is formed in the direction shown in the diagram, an object can be fastened by crossing other fasteners. In summary, the direction of the connecting hole or the connecting groove has to be in parallel with the longitudinal direction of the fixing member in the fastener.

In addition, in the fastening belt, the belt part which is the fixing member, and the buckle which includes the fixing part which serves as the fixing component may not be combined in one part, and the buckle may be detachably attached to the belt.

FIG. 18B (f) to FIG. 18B (h) respectively show examples of buckles for fasteners which fixes an object in a crossed manner.

The buckles shown in FIG. 18B (f) and FIG. 18B (g), are buckles of the same type for the fastening belt 465 shown in FIG. 18B (d) and FIG. 18B (e), and are fixed with the fixing part 465*a* by binding the belt part. In addition, both of the buckles include a setting part 465*d* for attaching the buckles to the belt part. The buckle shown in FIG. 18 (*f*), is attached to the belt part by cutting into the back edge of the setting part 465*d* to the belt part. The buckle shown in FIG. 18 (*g*), is attached to the belt part by cutting into the top edge of the setting part 465*d* to the belt part.

In addition, the buckle shown in FIG. 18B (f), includes a connecting hole 465*c* formed in a direction which is vertical to the longitudinal direction of the fastener and is in parallel with a plane including a loop formed by the fastener when fastening an object, as well as the fastening belt 465 shown in FIG. 18B (e).

The buckle shown in FIG. 18B (g), includes a connecting groove 465*e*, instead of a connecting hole. With the connecting groove 465*e*, as described with reference to FIG. 18A (c1) and FIG. 18A (c2), an object can be fastened with crossed fasteners by connecting a fastener with the other fastener after the object if fastened with the other fastener.

The buckle shown in FIG. 18B (h), is a buckle of the same type as shown in the buckle of the fastening belt 464 shown in FIG. 18B (c), and can fix the belt part by inserting the fixing part 464*b* to the hole of the belt part. In addition, the buckle includes a setting part 464*d* for attaching the buckles to the belt part and a through hole 464*e* formed in the same direction as the connecting hole 465*c* in FIG. 18B (f). The buckle shown in FIG. 18 (*h*), is attached to the belt part by cutting into the back edge of the setting part 464*d* to the belt part.

As described above, in a fastening belt for fastening an object by crossing the fastening belt, buckles may be detachably attached to the belt part. With this, for example, the band or the belt can be replaced when it is damaged. The same applies to the case where the buckle is damaged.

Note that the connecting hole or the connecting groove for connecting the fastener with the other fastener, may be in the belt or the band, instead of a fixing component such as a buckle. In summary, the fastener have only to include a hole or a groove for connecting the fastener with the other fastener.

In addition, the fastener and its components for fastening an object by crossing the fasteners may have a structure aside from the ones shown in FIG. 18B (a) to FIG. 18B (h).

Figure 18C:
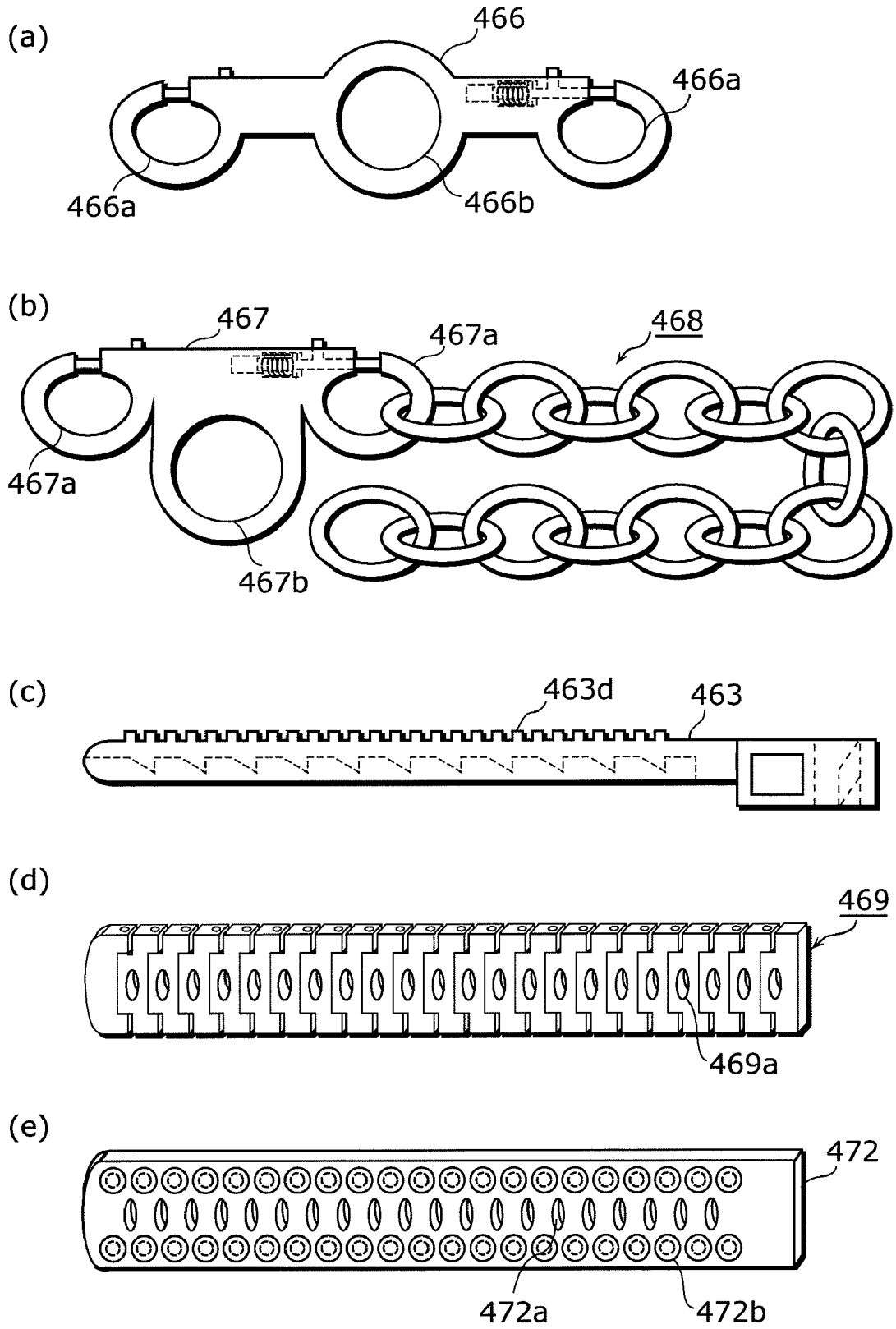
FIG. 18C shows another example of a fastener for fastening an object by crossing the fasteners, and their components.

FIG. 18C shows another example of fasteners, which fastens an object by crossing the fasteners, and their components.

FIG. 18C (a) is an example of a clasp for a fastening chain which fastens an object using a chain. The fastening chain uses a chain as a fixing member, and the clasp serves as the fixing component in the fastening chain.

As shown in FIG. 18C (a), the clasp 466 includes a connecting hole 466*b* for connecting the fastener with the other fastener, and two fixing parts 466*a* for fixing the chain.

One of the two fixing part 466*a* is used for attaching the chain before fastening the object, and the other fixing part is used for fixing the chain when fastening the object.

The fixing part 466*a* includes a closed hole, and there is an opening/closing part which can be slid in a part of the hole circumference. In addition, the opening/closing part is usually closed with the force of spring. When attaching or fixing a chain, the circumference of the fixing part 466*a* is passed through one of a loop member out of loop members making up of a chain with the opening/closed part opened. Thereafter, the opening/closing part is closed with the force of spring.

FIG. 18C (b) is a schematic diagram of the structure of fastening chain. The fastening chain shown in FIG. 18C (b) is made up of the clasp 467 and the chain 468.

The clasp 467 is different from the clasp 466 shown in FIG. 18C (a) in shape, but has the same function. More specifically, the clasp 467 includes a connecting hole 467*b* and two fixing units 467*a* for fixing the chain.

The chain 468 is formed of multiple loop members. In addition, one of the end is attached to one of the fixing part 467*a*. When fastening an object using the fastening chain, a loop member other than the loop member used for attaching the fastener to the clasp 467 is fixed with the other fixing part 467*a*.

For the loop member, a material such as metal, plastic, rubber, which has enough strength for fastening an object is used. In addition, since multiple loop members are connected to form the chain, each loop member does not have to be flexible.

In addition, the connecting holes shown in FIG. 18A (a), FIG. 18B (c), FIG. 18B (d), FIG. 18B (f), FIG. 18B (h), FIG. 18C (a), FIG. 18C (b) may be able to opened/closed like the fixing part 466*a*.

When fastening an object using two of these fastening bands, fastening belt, and fastening chains, the object is fastened, for example, in the order which is described below. Note that each of the two fasteners is referred to the fastener A and the fastener B.

(1) The fixing member of the fastener A is passed through the connecting hole or the connecting groove of the fastener B. (2) The fixing member of the fastener B is passed through the connecting hole or the connecting groove of the fastener A. (3) Place an object between the fastener A and the fastener B. (4) The fixing member of the fastener A is passed through the fixing component of the fastener A. (5) The fixing member of the fastener B is passed through the fixing component of the fastener B. (6) The object is fastened with the fixing member of the fastener A and the fixing member of the fastener B. (7) The fixing member of the fastener A is fixed so that the fixing member cannot be inserted/withdrawn from the fixing component of the fastener A. (8) The fixing member of the fastener B is fixed so that the fixing member cannot be inserted/withdrawn from the fixing component of the fastener B.

With the order above, the object is fastened with the two fasteners crossed.

Note that the order described above is an example, and the order may not be the same. For example, as described above, when the fastener is provided with a connecting groove, the object can be fastened by connecting the fastener with the other fastener after the other fastener fastened the object.

In addition, the fixing component may be a locking unit which can lock the object so as to be unlocked, unlike a fastening band or a fastening belt which simply fixes a fixing member. For example, the dial lock shown in FIG. 18A (a), can be used as a fastener.

In addition, the object may be fastened with two different fastening bands, and the object may be fastened by crossing a fastening band and a fastening chain.

Note that when a locking method for locking an object by tightening the object in a crossed manner with two locking devices, or when a fastening method for fastening an object with two crossed fasteners, the fixing member passing through the through hole or the through groove may be moved to a direction which the fixing member is through or the opposite direction with respect to the through hole or the through groove. Thus, when the fastener is subject to a force, it is possible that the closed loop part formed with each of fixing member passed through the fixing component of each of the fastener rotates or slides on the object while keeping the size, or slides while each of the connecting hole or the connecting hole facing the object, the fastener is misaligned with the object and may slip off the object. More specifically, if the fastener rotates or slides around the object, it may slip off the object. Thus, it is possible to include concaves and convexes or adhesive disks on the surface of the fixing member where it contacts the object in order to securely lock or fasten the object. In addition, it is presumable to fix the fixing member more closely to the object. With this, the fastener is less likely to rotate or slide around the object.

FIG. 18C (c) shows a case where the fastening band 463 shown in FIG. 18B (a) includes convexes 463*d* on the surface where the band contacts an object to be fastened. When the object is fastened, misalignment is less likely to occur between the fastener and the object with the convexes 463*d* cutting into the object, or fixing with the corners or the object. In addition, the band is less likely to slip in the through hole or the through groove through which the band passes.

FIG. 18C (d) shows a caterpillar-shaped belt which can be used as a fixing member of the fastening belt. The belt 469 shown in FIG. 18C (d), as well as the fixing member shown in FIG. 11, plate members are connected so that they can be flexed, and the belt 469 includes multiple holes 469*a* for fixing the belt to the buckle which is the fixing component. Note that any of the buckles shown in FIG. 18B (f) to FIG. 18B (h) may be attached, and the fastening belt can be used as a fixing belt.

In addition, since each of the plate members may not be flexible, and thus they can be made of metal, for example. Even when the plate member is made of metal, the plate member has enough degree of adhesion for fastening the object securely since it can be flexed.

FIG. 18C (e) shows a belt which can be used as a fixing member of the fastening belt, which includes adhesive disks 472*b* on the surface contacting the object. The adhesive disks 472*b* provided on the band 472 shown in FIG. 18C (e), prevents misalignment between the band and the object by being adhered to the object. In addition, since the adhesive disk 472*b* itself serves as a convex, and thus it is effective for preventing the misalignment between the object or in the through hole or the through groove even if the adhesive disks cannot be adhered to the surface of object.

In addition, as well as the band 469 shown in FIG. 18C (d), the band 472 includes holes 472*a* for fixing the band, any of the buckles shown in FIG. 18B (f) to FIG. 18B (h) may be attached, and the band 472 can be used as a fixing belt.

The structures of the concaves and convexes of band or belt, or adhesive disks shown in FIG. 18C (c) to FIG. 18C (e) are, needless to say, applicable to the fixing member in the locking device.

In addition, the band or belt may be in shape other than the ones described above. In summary, the band or the belt has only to be in a size, flexibility and strength for fastening an object.

As described above, an object can be locked or fastened using two locking devices or fasteners. The locking device or fastener for locking or fastening the object in a crossed manner does not require other particular member to lock or fasten the object in a crossed manner, and can be realized by a connecting hole or connecting groove for connecting the locking device or the fastener with the other locking device and the fastener.

In addition, the connecting hole or connecting groove may have a fixing function, as well as the dial lock described above. For example, the connecting hole 463*c* in FIG. 18B (a) may include the click 463*b*. In this case, the size of the connecting hole 463*c* may be adjusted so as to be in the same shape as the fixing component. With this, as well as the locking device described above, the band or belt can only be moved to one direction even at the connecting hole part. Thus it is useful in the case where the band or the belt does not cut into the object because the object to be fixed is stiff, if the band is tied in such a manner that the band of the other fastener stops at the convexes even if it moves at the connecting hole, considering the concaves and convexes of the object to be fastened.

In addition, in the fastening belt 465 shown in FIG. 18B (e), since the fastening belt is provided with two connecting holes 465*c*, an object can be fastened while being tightened from three directions with other two fasteners. To put it differently, the fastener may include two or more connecting holes or connecting grooves.

Figure 18D:
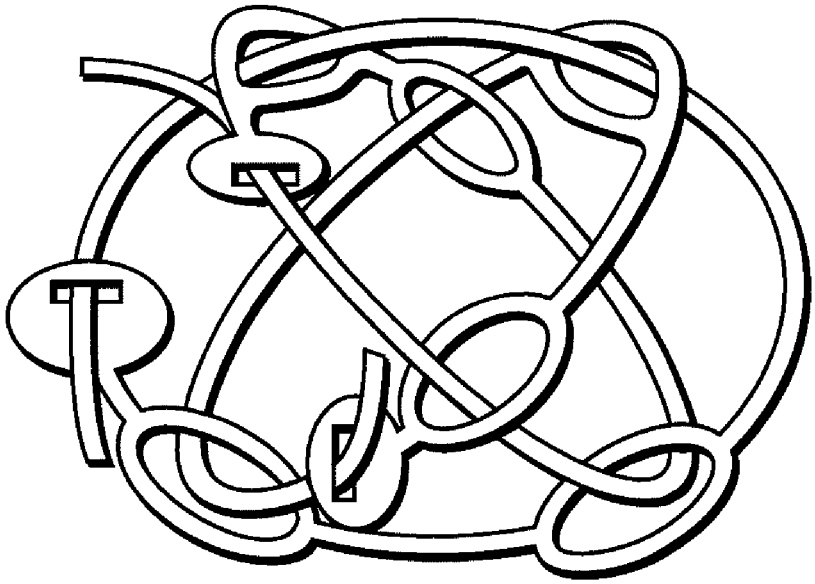
FIG. 18D shows an schematic view when an object is fastened with three fastening belts shown in FIG. 18B (e), and a schematic view when an object is fastened with four fastening belts.
Figure 18D:
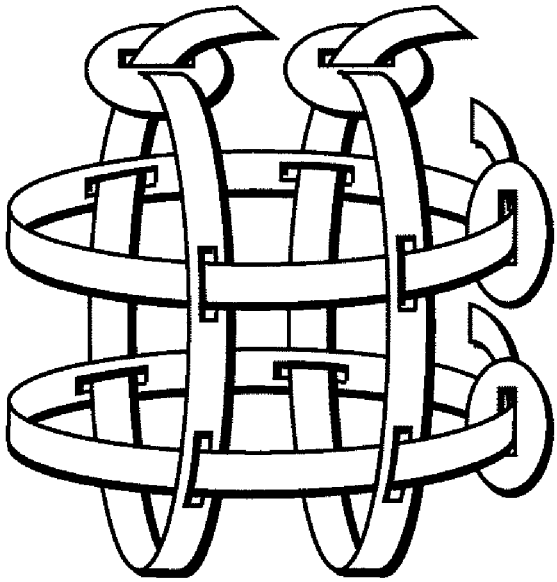

FIG. 18D (a) shows a schematic diagram when three fasteners are used. More specifically, as shown in FIG. 18D (a), a fastening method for fastening an object using three fasteners, wherein each of the fasters includes: a fixing member which takes a lengthy shape; a fixing component which passes through the fixing member and fixes the fixing member at a predetermined position; and two or more connecting holes or connecting grooves for connecting the fastener with other fastener, each of the connecting holes or the connecting grooves of the three fasteners being not in parallel with the longitudinal direction of the fixing member of the fasteners, and being able to connect the other fastener, said fastening method comprises: passing, using two respective connecting holes or connecting grooves of the three fasteners, a fixing member of a first fastener through a connecting hole or a connecting groove provided nearer to the other side of a fixing component of a second fastener in such a manner that each of said three fasteners does not cross each other except on the connecting hole or the connecting groove; passing the fixing member of the first fastener through a connecting hole or a connecting groove of the third fastener on the side of a fixing component; passing a fixing member of the second fastener through a connecting hole or a connecting groove of the third fastener on the other side of the fixing component; passing the fixing member of the second fastener through a connecting hole or a connecting groove of the first fastener on the side of the fixing component, passing the fixing member of the third fastener through a connecting hole or a connecting groove of the first fastener on the other side of the fixing component; passing the fixing member of the third fastener through a connecting hole or a connecting groove of the second fastener on the side of the fixing component of the second fastener; placing the object between the first fastener, the second fastener, and the third fastener; passing the fixing member of the first fastener through the fixing component of the first fastener; passing the fixing member of the second fastener through the fixing component of the second fastener; passing the fixing member of the third fastener through the fixing component of the third fastener; fastening the object with the fixing member of the first fastener, the fixing member of the second fastener, and the fixing member of the third fastener, directions of the three fasteners are different from one another; fixing the fixing member of the first fastener so as not to be inserted/withdrawn from the fixing component of the first fastener; fixing the fixing member of the second fastener so as not to be inserted/withdrawn from the fixing component of the second fastener; and fixing the fixing member of the third fastener so as not to be inserted/withdrawn from the fixing component of the third fastener. Note that the order described above is an example, and the order may not be the same. In addition, the fixing component may be provided with locking function. Note that, in the case where three fasteners are used, a spherical object can be easily fastened if the position of the connecting hole or the connecting groove can be adjusted.

In addition, FIG. 18D (b) shows a schematic diagram when four fasteners are used. More specifically, as shown in FIG. 18D (b), a fastening method for fastening an object using four fasteners, wherein each of the fasters includes: a fixing member which takes a lengthy shape; a fixing component which passes through the fixing member and fixes the fixing member at a predetermined position; and two or more connecting holes or connecting grooves for connecting the fastener with other fastener, each of the connecting holes or the connecting grooves of the four fasteners being not in parallel with the longitudinal direction of the fixing member of the fasteners, and being able to connect the other fastener, said fastening method comprises: passing, using two respective connecting holes or connecting grooves of the four fasteners, a fixing member of a first fastener through a connecting hole or a connecting groove provided nearer to the other side of a fixing component of a third fastener in such a manner that each of said four fasteners does not cross each other except on the connecting hole or the connecting groove; passing the fixing member of the first fastener through a connecting hole or a connecting groove of the fourth fastener; passing a fixing member of the second fastener through a connecting hole or a connecting groove of the third fastener; passing the fixing member of the second fastener through a connecting hole or a connecting groove of the fourth fastener; passing the fixing member of the third fastener through a connecting hole or a connecting groove of the first fastener; passing the fixing member of the third fastener through a connecting hole or a connecting groove of the second fastener; passing the fixing member of the fourth fastener through a connecting hole or a connecting groove of the first fastener; passing the fixing member of the fourth fastener through a connecting hole or a connecting groove of the second fastener; placing the object between the first fastener, the second fastener, the third fastener, and the fourth fastener; passing the fixing member of the first fastener through the fixing component of the first fastener; passing the fixing member of the second fastener through the fixing component of the second fastener; passing the fixing member of the third fastener through the fixing component of the third fastener; passing the fixing member of the fourth fastener through the fixing component of the fourth fastener; fastening the object with the fixing member of the first fastener, the fixing member of the second fastener, the fixing member of the third fastener, and the fixing member of the fourth fastener; fixing the fixing member of the first fastener so as not to be inserted/withdrawn from the fixing component of the first fastener; fixing the fixing member of the second fastener so as not to be inserted/withdrawn from the fixing component of the second fastener; fixing the fixing member of the third fastener so as not to be inserted/withdrawn from the fixing component of the third fastener; and fixing the fixing member of the fourth fastener so as not to be inserted/withdrawn from the fixing component of the fourth fastener. Note that the order described above is an example, and the order may not be the same. In addition, where there is a bumpy part in the object, an object is fastened by binding the four different fasteners with the bump of the object in a square formed with the four different fasteners, each of the corners being the four connecting holes of the connecting grooves with the fastening method. With this, the fasteners are stopped by the bumpy part from sliding, preventing the fasteners being slipped off of the object. Furthermore, when there is no bumpy part in the object, a plate attachment with a bump around the center is used. With this, books and documents are securely fastened, and when the fixing component has a locking function, the books can be securely locked. In addition, in the case where four fasteners are used, a spherical object can be easily fastened if the positions of the connecting holes or the connecting grooves are adjusted.

In addition, a locking device which can be disassembled only when unlocked can be configured by connecting the shaft member and the lock body in such a manner that they cannot be removed when locked, and restricting the movement of the dial rings with a flange for preventing the dial rings to be removed, provided at the back edge of the shaft member and a wall of the lock body.

Figure 19:
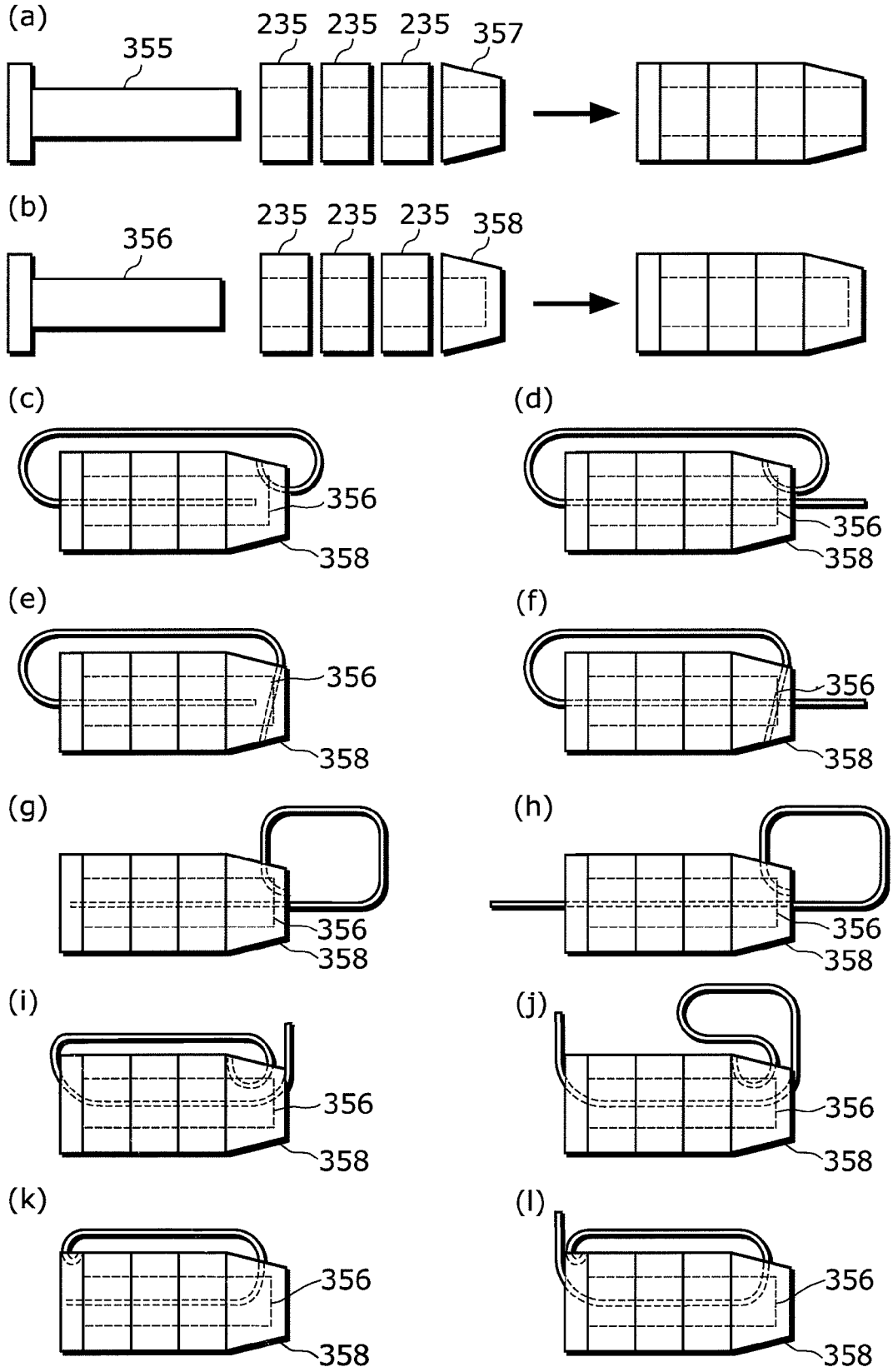
FIG. 19 shows examples of dial lock structure which prevents movement of the dial rings towards the shaft by a flange provided in the shaft member and a wall in the lock.

FIG. 19 shows examples of structures of dial locks for preventing the movement of the dial rings to the shaft direction with a flange provided on the shaft member and the wall of the lock body, by connecting the shaft member and the lock body by having a passage for the fixing member crossing the boundary of the lock body and the shaft member to a direction different from the inserting/withdrawing direction of the shaft member with respect to the lock body at the shaft side position.

The dial lock shown in FIG. 19 (*a*) includes a shaft with flange 355, three lock dial rings 235 and the lock body 357. In addition, the lock body 357 includes a hole through which the shaft with flange 355 passes. By combining these members, a dial lock shown on the right side of the arrow in the diagram is made up.

The dial lock shown in FIG. 19 (*b*) includes a shaft with flange 356, three lock dial rings 235 and the lock body 358. In addition, the lock body 358 includes a hole to which the shaft with flange 356 is inserted. By combining these members, a dial lock shown on the right side of the arrow in the diagram is made up.

In each of the dial locks shown in FIG. 19 (*a*), and FIG. 19 (*b*), the lock dial rings 235 cannot move to the right with the left side of the lock body interferes the lock dial ring, and cannot move to the left, interrupted with the flange of the shaft with flange. Note that in FIG. 19 (*a*) and FIG. 19 (*b*), description for the structure such as shaft side grooves and the like which the shaft with flange 355 and the shaft with flange 356 are provided with are omitted. In addition, in each dial lock, the shaft with flange is held by the lock body. Furthermore, each of the diagrams shows a schematic view of the structure of dial locks when viewed from a direction where the cutout in the lock dial ring of the unlocked lock.

FIG. 19 (*c*) to FIG. 19 (*l*) shows variations of the passage for fixing member crossing the boundary of the lock body and the shaft with flange at the shaft side position in order to connect the lock body and the shaft with flange shown in FIG. 19 (*b*) and not to be disassembled when locked. Note that the three dial rings provided for each of the dial locks are the lock dial rings 235. In addition, the dial lock in FIG. 19 (*c*) to FIG. 19 (*j*), the fixing member is inserted from the fixing member setting groove of the fixing member setting hole of the lock body 358, and the end of the fixing member is fixed at the fixing member setting groove of the fixing member or the fixing member setting hole of the lock body 358. In addition, the dial locks shown in FIG. 19 (*k*) and FIG. 19 (*l*), the fixing member is inserted from the flange part of the shaft with flange 356 and the end of the fixing member is fixed at the fixing member setting groove or the fixing member setting hole at the flange.

The dial lock shown in FIG. 19 (*c*) includes a lock body 358 and a passage which passes through the part of the shaft with flange in the lock body 358 (hereinafter referred to as "connecting passage"). The connecting passage is a passage crossing the boundary of the lock body 358 and the part of the shaft with flange 356 in the lock body 358 at the shaft side position. The fixing member from the passage is inserted from the flange part of the shaft with flange 356, and is fixed with the three lock dial rings without passing through the shaft with flange 356. In other words, the shaft side groove to which the three lock dial rings pass through (hereinafter referred to as "shaft side groove for fixing") does not pass through the shaft with flange 356.

The fixing member is in the connecting passage and the connecting passage is formed to a direction different from the inserting/withdrawing direction of the shaft with flange 356 with respect to the lock body 358. Therefore, the lock body 358 and the shaft with flange 356 cannot be separated at least when the lock is locked. In addition, when unlocked, the dial lock is disassembled by removing the fixing member from the part where passing through the connecting passage of the lock body 358 and the shaft with flange 356 to separate the lock body 358 and the shaft with flange 356. In other words, the dial lock can only be disassembled when unlocked.

The dial lock shown in FIG. 19 (*d*), has approximately the same structure as the dial lock shown in FIG. 19 (*c*), and includes a connecting passage of the same location and shape. However, the shaft side groove for fixing in the shaft with flange 356 passes through the shaft with flange 356, and the lock body includes a hole for passing the fixing member through the position continuous to the shaft side groove for fixing.

In the dial lock shown in FIG. 19 (*d*), with the connecting passage, the lock body 358 and the shaft with flange 356 cannot be separated at least when locked. However, the dial lock can only be disassembled when unlocked as well as FIG. 19 (*c*).

The dial lock shown in FIG. 19 (*e*), has different shape of connecting passage from the dial lock shown in FIG. 19 (*c*), however, the dial lock cannot be disassembled when locked and can only be disassembled when unlocked as well as the dial lock shown in FIG. 19 (*c*).

The dial lock shown in FIG. 19 (*f*), as well as the dial lock shown in FIG. 19 (*d*), includes a shaft side groove for fixing which passes through the shaft with flange 356, and the lock body includes a hole for passing a fixing member through the position continuous to the shaft side groove for fixing. In addition, the dial lock includes a connecting passage as well as the dial lock shown in FIG. 19 (*e*). Note that the connecting passage and the passage including the shaft side groove for fixing are skew, and are not crossed. This connecting passage enables a dial lock which can only be disassembled when unlocked.

In the dial lock shown in FIG. 19 (*g*), the fixing member passed through the connecting passage is inserted from the shaft top side of the lock body 358, and the fixing member is inserted to the shaft from the shaft top of the shaft with flange 356. In addition, the shaft side groove for fixing does not pass through the shaft with flange 356. As described above, even when the fixing member is inserted to the shaft side groove for fixing from the lock body 358 side, not from the flange part side of the shaft with flange 356, the fixing member can be fixed with the lock dial rings. In addition, since the connecting passage is formed in a direction different from the inserting/withdrawing direction of the shaft with flange 356 to the lock body 358, the dial lock can only be disassembled when unlocked.

The dial lock shown in FIG. 19 (*h*) includes a connecting passage of the same location and shape of the dial lock shown in FIG. 19 (*g*). As well the dial lock shown in FIG. 19 (*g*), the fixing member passed through the connecting passage is inserted from the shaft top side of the lock body 358. Furthermore, the inserted fixing member passes through the lock body 358 and the shaft with flange 356. As described above, even when the shaft side groove for fixing passes through the shaft with flange 356, as well as the dial lock shown in FIG. 19 (*g*), the fixing member can be fixed. The connecting passage enables a dial lock which can only be disassembled when unlocked.

Note that, by modifying the structures of the fixing member setting groove of the fixing member setting hole shown in FIG. 19 (*d*) so that the fixing member can be set with the fixing member to be inserted from either one of the sides, the dial lock can be locked in the same shape as shown in FIG. 19 (*h*). In other words, by modifying the fixing member setting groove and the fixing member setting hole, a lock can be used for the different ways shown in FIG. 19 (*d*) and FIG. 19 (*h*).

In the dial lock shown in FIG. 19 (*i*), as well as the dial lock shown in FIG. 19 (*d*), the fixing member passed through the connecting passage is inserted to the shaft side groove for fixing from the flange part of the shaft with flange 356, and passes through the shaft with flange 356 and the lock body 358. However, both sides of the passage including the shaft side groove for fixing are curved. These curves, as described with reference to FIG. 10 (*d*) to FIG. 10 (*g*), are effective for preventing the parts for unlocking from seeing via this passage. In addition, since the connecting passage is formed in a direction different from the inserting/withdrawing direction of the shaft with flange 356 to the lock body 358, the dial lock can only be disassembled when unlocked.

The dial lock shown in FIG. 19 (*j*), as well as the dial lock shown in FIG. 19 (*i*), both ends of the passage including the shaft side groove for fixing are curved, preventing the part for unlocking being seen. In addition, As well the dial lock shown in FIG. 19 (*h*), the fixing member passed through the connecting passage is inserted from the shaft top side of the lock body 358 and passes through the lock body 358 and the shaft with flange 356. The connecting passage enables, with the connecting passage, a dial lock which can only be disassembled when unlocked.

Note that each of the passages shown in FIG. 19 (*i*) and FIG. 19 (*j*) and a passage including the shaft side groove for fixing may be the same passage. More specifically, in the same dial lock, the fixing member passed through the connecting passage can be locked by inserting the fixing member from the shaft top side or from the other side.

In the dial lock shown in FIG. 19 (*k*), unlike the dial locks shown in FIG. 19 (*c*) to FIG. 19 (*j*), the fixing member is passed through the flange part of the shaft with flange 356, and the end of the fixing member is fixed at the flange part. In addition, a passage for fixing member which crosses the boundary of the lock body and the shaft with flange to a direction different from the inserting/withdrawing direction of the shaft member with respect to the lock body at the shaft side position, and fixed with the dial ring 235 with the fixing member crossing the boundary. More specifically, a part of the shaft side groove for fixing is formed in a direction different from the inserting/withdrawing direction of the shaft member with respect to the lock body. Note that, the shaft side groove for fixing does not pass through the shaft with flange 356.

Here, as described in FIG. 19 (*k*), when the fixing member is in the part crossing the boundary of the lock body 358 and the shaft with flange 356, at the shaft side position, to a direction different from the inserting/withdrawing direction of the shaft with flange 356 to the lock body 358, regardless of the presence of the body side groove, the shaft with flange 356 cannot be withdrawn from the lock body 358.

In addition, even when the passage for fixing member does not cross the boundary of the lock body 358 and the shaft with flange 356 at the shaft side position, if there is a body side groove, and by forming a part of hole formed with the shaft side groove for fixing and the body side groove to a direction different from the inserting/withdrawing direction of the shaft with flange 356 to the lock body 358, the fixing member in the shaft side groove part for fixing formed in a direction different from the inserting/withdrawing direction of the shaft with flange 356 is over the body side groove. Thus, the shaft with flange 356 cannot be withdrawn from the lock body 358.

In other words, the dial lock shown in FIG. 19 (*k*), is a dial lock which can be disassembled only when unlocked. In addition, it is possible to prevent the part for unlocking the lock from being seen with the end of the passage including the shaft side groove for fixing on the lock body 358 side.

In addition, even when the passage for fixing member does not cross the boundary of the lock body 358 and the shaft with flange 356 at the shaft side position, if there is a body side groove, and by forming a part of hole formed with the shaft side groove for fixing and the body side groove to a direction different from the inserting/withdrawing direction of the shaft with flange 356 to the lock body 358, the fixing member in the shaft side groove part for fixing formed in a direction different from the inserting/withdrawing direction of the shaft with flange 356 is over the body side groove. Thus, the shaft with flange 356 cannot be withdrawn from the lock body 358.

The dial lock shown in FIG. 19 (*i*), has the same structure as the dial lock shown in FIG. 19 (*k*), and a part of the shaft side groove for fixing is formed to a direction different from the inserting/withdrawing direction of the shaft with flange 356 to the lock body 358. Furthermore, the shaft side groove for fixing passes through the shaft with flange 356. In addition, both sides of the passage including the shaft side groove for fixing are curved.

Therefore, the dial lock is effective for preventing the unlocking part from being seen as well as the dial lock shown in FIG. 19 (*k*). In addition, as well as the dial lock shown in FIG. 19 (*k*), even when the fixing member is loose or when the lock is unlocked, the lock body 358 and the shaft with flange 356 cannot be separated unless the fixing member is withdrawn from the boundary of the lock body 358 and the shaft member 356.

In addition, although the fixing member in FIG. 19 (*k*) and FIG. 19 (*l*) is inserted from the shaft top side, the fixing member may be inserted from the flange side of the shaft with flange 356, and curved or flexed to make up a dial lock which can be disassembled only when unlocked.

FIG. 19 (*c*) to FIG. 19 (*l*) shows variations of the passage for fixing member in the dial lock shown in FIG. 19 (*b*). The same variations is applicable to FIG. 19 (*a*), and the dial lock can only be disassembled when unlocked.

Note that, each of the dial locks shown in FIG. 19 (*a*) to FIG. 19 (*l*) includes the shaft with flange 355 and the lock body 357, or the shaft with flange 356 and the lock body 358, except for three lock dial rings. However, the dial lock may be made up of a flange without a shaft and a lock body with a shaft. For example, suppose the member for fixing the end of the fixing member is the lock body, the dial locks in FIG. 19 (*k*) and FIG. 19 (*l*) are made up of a lock body with a shaft and a flange or other sub materials which can be attached to the shaft.

In short, the member for preventing the lock dial rings from falling off both ends of the shaft is on both ends of the shaft, and at least one of the two members at the ends may be removed when unlocked. The structure which enables the member to be removed only when unlocked may be realized by the direction of the shaft side groove and the presence of the connecting passage.

Note that umbrellas and documents are listed as objects to be locked with the dial lock, but the object may be other goods.

In addition, the dial lock and the members making up the dial lock in the embodiment and the application or the modification may be used with other usage or other use. For example, when the wire shown in FIG. 7 and the attachments shown in FIG. 16 and FIG. 17 are used with a band-type cylinder lock and a card lock, not only the dial lock according to this embodiment, but the functions or the effects of the wire, attachments, and bands are not lost.

In addition, for example, the structural features of the dial lock and the locking method for locking books and the like using two dial locks as shown in FIG. 18A are applicable to a locking device with other structure such as a band type cylinder lock and card lock, not only to a dial lock according to this embodiment.

In addition, for example, as the lock body 100 shown in FIG. 5, locking the object by attaching the lock closely by having an arc shaped surface on the side contacting the object to be locked is effective for a locking device with other structure such as a band type cylinder lock and a card lock.

As described above, the locking device according to this embodiment enables disassembling/assembling of the lock only when unlocked without using a specialized parts such as retainer for holding the dial ring and the shaft or a pin in a band type dial lock which can fix the band any position, and a dial lock which locks the fixing member at a predetermined position. Furthermore, the components of lock can be easily replaced.

In addition, the dial lock 1 includes three dial rings and has a three-digit unlocking number, however, the number of dial rings may be two or more than four. For example, in the dial lock 1 shown in FIG. 1, the structure in which the lock dial ring 200 locks the band body of the band 400 is independent in each of the lock dial rings 200, and thus it is possible to manufacture the dial lock 1 with 4 or more lock dial rings 200.

With this, the combination for unlocking number can be increased, thereby improving the effect for preventing the object being stolen.

Although only some exemplary embodiment of this invention has been described in detail above, those skilled in the art will readily appreciate that many modifications are possible in the exemplary embodiment without materially departing from the novel teachings and advantages of this invention. Accordingly, all such modifications are intended to be included within the scope of this invention.

INDUSTRIAL APPLICABILITY

The locking device according to the present invention requires less types of component and thus unauthorized unlocking can be prevented without small components such as pins and retainers. Therefore, the present invention is effective for a locking device for locking an object.

What is claimed is:

1. A locking device comprising:

a lock body;

a plurality of dial rings; and a fixing member which is elongated in shape and is locked by being directly fixed with said plurality of dial rings, wherein said fixing member includes a convex-concave part with repeated concaves and convexes formed in a longitudinal direction of said fixing member, wherein each of said plurality of dial rings includes a cutout which is provided on a part of a circumferential direction in such a manner that allows said fixing member to be freely insertable and removable at a rotation position which is an unlocking position and that at least one of said plurality of dial rings abuts the convexes of the concave-convex part at a rotation position except for the unlocking position, wherein said locking device further includes a passage to removably receive said fixing member, an insertion section of the passage extends to one of said plurality of dial rings from outside said locking device, and the insertion section of the passage is curved or angled along a direction of removably inserting said fixing member such that the cutout of each of said plurality of dial rings is not visible outside said locking device from the insertion section of the passage when said fixing member is not inserted into the insertion section of the passage and the insertion section of the passage is viewed from any direction, and wherein when said plurality of dial rings are in the unlocking position, the cutout of each of said plurality of dial rings forms a part of the passage to allow the convexes of said fixing member to pass through the cutouts.

2. The locking device according to claim 1, said locking device further comprising:

a shaft which is to be held by said lock body, wherein said shaft is a rotation shaft of said plurality of dial rings, said lock body includes a side shaft opening through which said shaft is inserted from outside and a body side groove through which said fixing member is inserted, said shaft includes a shaft side groove through which said fixing member is inserted, the body side groove along with the shaft side groove form at least a part of the passage, wherein at least a part of the shaft side groove is formed in a direction different from a direction of removably inserting said shaft with respect to the side shaft opening of said lock body, and the body side groove and the shaft side groove are arranged in a direction generally perpendicular to the direction of removably inserting said fixing member.

3. The locking device according to claim 2, wherein the body side groove is located on an inner periphery of the side shaft opening so that the shaft side groove and the body side groove form the passage when said shaft is inserted into the side shaft opening, and wherein at least a part of a direction of the passage formed with the shaft side groove and the body side groove is formed in a direction different from the direction of removably inserting said shaft with respect to the side shaft opening of said lock body.

4. The locking device according to claim 2, wherein said lock body includes walls restraining the movement of said plurality of dial rings in the direction of removably inserting said shaft with respect to the side shaft opening of said lock body.

5. The locking device according to claim 4, wherein at least an end of the shaft side groove of both ends of the shaft side groove in the direction of removably inserting said fixing member is not on an edge face of said shaft and is only on the circumference of said shaft.

6. The locking device according to claim 1, wherein the passage passes through said locking device, wherein the concave-convex part of said fixing member includes more convexes or concaves than the number of said plurality of dial rings, and wherein said locking device further includes an opening at an end of the passage such that a distal portion of said fixing member in the direction of removably inserting said fixing member can be passed from the insertion section through said plurality of dial rings and be pulled out from the opening at the end of the passage to outside said locking device.

* * * * *